United States Patent [19]

Miller et al.

[11] Patent Number: 4,838,434

[45] Date of Patent: Jun. 13, 1989

[54] AIR SPARGED HYDROCYCLONE FLOTATION APPARATUS AND METHODS FOR SEPARATING PARTICLES FROM A PARTICULATE SUSPENSION

[75] Inventors: Jan D. Miller; Ye Yi, both of Salt Lake City, Utah

[73] Assignee: University of Utah, Salt Lake City, Utah

[21] Appl. No.: 194,823

[22] Filed: May 17, 1988

Related U.S. Application Data

[63] Continuation-in-part of Ser. No. 842,697, Mar. 21, 1986, Pat. No. 4,744,890, which is a continuation of Ser. No. 680,613, Dec. 11, 1984, abandoned, which is a continuation of Ser. No. 465,748, Feb. 11, 1983, abandoned, which is a continuation-in-part of Ser. No. 323,336, Nov. 20, 1981, Pat. No. 4,397,741, which is a continuation-in-part of Ser. No. 182,524, Aug. 29, 1980, Pat. No. 4,399,027, which is a continuation-in-part of Ser. No. 94,521, Nov. 15, 1979, Pat. No. 4,279,743.

[51] Int. Cl.[4] ..... B03D 1/02; B04C 5/103; B04C 5/16

[52] U.S. Cl. ..... 209/164; 209/170; 209/211; 210/512.1; 210/221.2; 210/788; 261/122

[58] Field of Search ..... 209/164, 169, 170, 211, 209/144; 210/512.1, 512.3, 512.2, 787, 788; 261/122; 55/459 R

[56] References Cited

U.S. PATENT DOCUMENTS

| | | |
|---|---|---|
| 1,149,463 | 8/1915 | Pardee . |
| 1,420,138 | 6/1922 | Peck . |
| 1,420,139 | 6/1922 | Peck . |
| 1,869,732 | 8/1932 | Asselstine . |

(List continued on next page.)

FOREIGN PATENT DOCUMENTS

| | | |
|---|---|---|
| 2740463 | 8/1964 | Australia . |
| 274774 | 5/1967 | Australia ..... 210/512.1 |
| 1105166 | 3/1968 | Australia . |
| 0029553 | 11/1980 | European Pat. Off. . |
| 1175621 | 8/1964 | Fed. Rep. of Germany . |
| 2748478 | 5/1978 | Fed. Rep. of Germany . |
| 2812105 | 9/1979 | Fed. Rep. of Germany . |
| 998240 | 1/1952 | France . |
| 1022375 | 3/1953 | France . |
| 60294 | 10/1954 | France . |

(List continued on next page.)

OTHER PUBLICATIONS

Bahr–"Development and Introduction of a New Coal Flotation Cell"–Report of 14th Int. Min. Proc. (10/82).

Foreman–"The Flotation of Slimes" Canadian Mining Manual, pp. 98–101.

*Primary Examiner*—Kenneth M. Schor

*Assistant Examiner*—Thomas M. Lithgow

*Attorney, Agent, or Firm*—Workman Nydegger & Jensen

[57] ABSTRACT

The present invention is directed to air sparged hydrocyclone flotation apparatus and methods for separating particles from particulate suspensions (such as coal and mineral ore slurries), wherein fluid discharge is removed annularly from a flotation vessel. Preferably, the flotation apparatus includes a vertically oriented cylindrical flotation vessel having a tangential inlet at its upper end and an annular outlet at its lower end. The annular outlet allows for the smooth exit of fluid discharge from the flotation vessel so as to avoid disturbance of the fluid flow within the flotation vessel. Air is sparged into the vessel and a froth which contains the recovery products exits through a vortex finder positioned in the upper end of the vessel. The apparatus includes a froth pedestal positioned within the vessel which forms the annular outlet with the wall of the vessel. The froth pedestal may take a generally cylindrical or a generally conical configuration. The conical froth pedestal extends into the vessel from near the bottom of the vessel to at least one-half the distance to the vortex finder. The froth pedestal further serves, among other things, to support the froth column formed within the flotation vessel and isolate the froth column from the fluid discharge so as to minimize mixing therebetween.

31 Claims, 11 Drawing Sheets

U.S. PATENT DOCUMENTS

| | | | |
|---|---|---|---|
| 2,054,643 | 9/1936 | Tucker | 209/170 |
| 2,354,311 | 7/1944 | Harlow | 209/144 |
| 2,532,885 | 12/1950 | Berges | 92/28 |
| 2,538,870 | 1/1951 | Hunter | 196/19 |
| 2,757,581 | 8/1956 | Freeman | 92/28 |
| 2,816,490 | 12/1957 | Boadway | 92/28 |
| 2,829,771 | 4/1958 | Dahlstran | 209/211 |
| 2,849,930 | 9/1958 | Freeman | 92/28 |
| 2,879,889 | 3/1959 | Rakowsky | 209/173 |
| 2,917,173 | 12/1959 | Rakowsky | 209/172.5 |
| 3,052,361 | 9/1962 | Whatley | 210/512 |
| 3,130,157 | 4/1964 | Kelsall | 210/512 |
| 3,219,186 | 11/1965 | Polhemus | 209/172.5 |
| 3,349,548 | 10/1967 | Boyen | 55/459 R |
| 3,391,787 | 7/1968 | Salomon | 210/84 |
| 3,426,513 | 2/1969 | Bauer | 55/459 R |
| 3,443,932 | 5/1969 | Melin | 75/101 |
| 3,446,353 | 5/1969 | Davis | 209/164 |
| 3,452,870 | 7/1969 | Katsuta | 210/94 |
| 3,489,686 | 1/1970 | Snavely | 210/23 |
| 3,557,956 | 1/1971 | Braun | 210/84 |
| 3,615,008 | 10/1971 | Alpha | 209/139 A |
| 3,687,286 | 8/1972 | Weiss | 209/211 |
| 3,759,385 | 9/1973 | Pouillon | 209/165 |
| 3,802,570 | 4/1974 | Dehue | 210/304 |
| 3,844,414 | 10/1974 | Jordison | 209/467 |
| 4,005,998 | 2/1977 | German | 55/459 R |
| 4,031,006 | 6/1977 | Ramerez | 210/44 |
| 4,076,507 | 2/1978 | Hanberg | 55/459 R |
| 4,097,375 | 6/1978 | Molitor | 210/23 |
| 4,165,841 | 8/1979 | Musselman | 241/46.02 |
| 4,208,276 | 6/1980 | Bahr | 209/168 |
| 4,212,730 | 7/1980 | Brooks | 209/168 |
| 4,216,095 | 8/1980 | Ruff | 210/512 R |
| 4,279,741 | 7/1981 | Campbell | 209/44 |
| 4,279,743 | 7/1981 | Miller | 209/211 |
| 4,397,741 | 8/1983 | Miller | 209/170 |
| 4,399,027 | 8/1983 | Miller | 209/164 |
| 4,597,859 | 7/1986 | Beck | 210/512.1 |
| 4,744,890 | 5/1988 | Miller et al. | 209/170 |

FOREIGN PATENT DOCUMENTS

| | | |
|---|---|---|
| 1249814 | 11/1960 | France . |
| 1356704 | 2/1964 | France . |
| 2263036 | 3/1975 | France . |
| 226259 | 4/1969 | Sweden . |
| 545385 | 3/1977 | U.S.S.R. . |
| 751437 | 7/1980 | U.S.S.R. . |
| 1005479 | 2/1964 | United Kingdom . |
| 1177176 | 3/1967 | United Kingdom . |
| 1500117 | 2/1978 | United Kingdom . |

COMPARISON OF THE EFFECTIVENESS OF THE PERFORMANCE OF THE AIR SPARGED HYDROCYCLONE WITH CONICAL FROTH PEDESTAL VERSUS THE AIR SPARGED HYDROCYCLONE WITH CYLINDRICAL PEDESTAL

AIR SPARGED HYDROCYCLONE FLOTATION APPARATUS AND METHODS FOR SEPARATING PARTICLES FROM A PARTICULATE SUSPENSION

BACKGROUND

The Related Applications

The present application is a continuation-in-part of application Ser. No. 06/842,697, filed Mar. 21, 1986 (now U.S. Pat. No. 4,744,890 issued May 17, 1988); which is a continuation of application Ser. No. 06/680,613, filed Dec. 11, 1984 (now abandoned); which is a continuation of application Ser. No. 06/465,748, filed Feb. 11, 1983 (now abandoned); which is a continuation-in-part of application Ser. No. 06/323,336, filed Nov. 20, 1981 (now U.S. Pat. No. 4,397,741 issued Aug. 9, 1983); which is a continuation-in-part of application Ser. No. 06/182,524, filed Aug. 29, 1980 (now U.S. Pat. No. 4,399,027 issued Aug. 16, 1983); which is a continuation-in-part of application Ser. No. 06/094,521, filed Nov. 15, 1979 (now U.S. Pat. No. 4,279,743 issued July 21, 1981).

1. The Field of the Invention

The present invention relates to air sparged hydrocyclone flotation apparatus and methods for use in the separation of particles from a particulate suspension. More particularly, the present invention relates to an improved froth pedestal design for air sparged hydrocyclone flotation apparatus and methods for separation of at least two products in a centrifugal field and resulting in an overflow froth concentrate containing the material to be recovered.

2. The Prior Art

A. Flotation Systems

Flotation is a process in which one or more specific particulate constituents of a slurry or suspension of finely dispersed particles become attached to gas bubbles so that these "bubbles/particle aggregates" can be separated from the other constituents of the slurry or suspension. The buoyancy of the bubble/particle aggregate, formed by the adhesion of the gas bubble to a particle in the slurry or suspension, is such that it rises to the surface of the flotation vessel where it is separated from the remaining particulate constituents which remain suspended in the aqueous phase of the suspension.

Flotation techniques can be applied where conventional gravity separation techniques fail. Indeed, flotation has supplanted the older gravity separation methods in solving a number of separation problems. Initially, flotation was used to separate sulphide ores of copper, lead, and zinc from associated gangue mineral particles. However, flotation is now also used for concentrating nonsulphide ores, for cleaning coal, for separating salts from their mother liquors, and for recovering elements such as sulphur and graphite.

During the past two decades, the application of flotation technology to mineral recovery in the United States has inceased at an annular rate of about 7.4%. Indeed, present flotation installations in the United States alone are capable of processing almost two million (2,000,000) tons of material per day.

The preferred method for removing the floated material is to form a froth or foam to collect the bubble/particle aggregates. The froth containing the collected bubble/particle aggregates can then be removed from the top of the suspension. This process is called "froth flotation" and is conducted as a continuous process in equipment called flotation cells. Froth flotation is accomplished by the introduction into the flotation cell of voluminous quantities of small bubbles, which in the previously available devices are typically in the range of from about 0.1 to about 2 millimeters in diameter.

In conventional processes, the success of flotation has depended upon controlling conditions in the particulate suspension so that the air is selectively retained by one or more particle constituents are rejected by the other particle constituents of the suspension. To achieve this selectivity, the slurry or particulate suspension is typically treated by the addition of small amounts of known chemicals or flotation enhancing reagents which selectively render hydrophobic one or more of the constituents in the particulate suspension.

Those chemicals which render hydrophobic a particulate constituent which is normally hydrophilic, are commonly referred to as "collectors." Chemicals which increase the hydrophobicity of a somewhat hydrophobic particulate constituent are commonly referred to as "promoters."

Treatment with a collector or promoter causes those constituents rendered hydrophobic to be repelled by the aqueous environment and attracted to the air bubbles. Most importantly, the hydrophobic nature of the surface of these constituents enhances attachment of air bubbles to the hydrophobic constituents. Thus, control of the surface chemistry of certain particulate constituents by the addition of flotation enhancing reagents such as a collector or promoter allows for selective formation of bubble/particle aggregates with respect to those constituents.

Other chemicals or flotation enhancing reagents may be used to help create the froth phase for the flotation process. Such chemicals are commonly referred to as "frothers." The most common frothers are short chain alcohols, such as methylisobutylcarbinol (MIBC), pine oil, and cresylic acid.

Important criteria related to the choice of an appropriate frother include the solubility and collecting properties of the frother, the toughness and texture of the froth, and froth breakage. An appropriate frother should thus be chosen to ensure that the froth will be sufficiently stable to carry the bubble/particle aggregates for subsequent removal as a flotation product or concentrate. As used herein, the term "concentrate" refers to the mixture of desired mineral product and other entrained minerals which are present in the froth product.

Additionally, the choice of frother should ensure a froth which will allow for proper drainage of water and for removal of misplaced hydrophilic particles from the froth. In practical flotation tests, the size, number, and stability of the bubbles formed during flotation may be optimized at given frother concentrations.

Thus, a complete flotation process is conducted in several steps:

(1) A slurry is prepared containing from about five percent to about forty percent (5%–40% by weight) solids in water;

(2) The necessary flotation enhancing reagents are added, and sufficient agitation and time is provided to distribute the reagents on the surface of the particles to be floated;

(3) The treated slurry is aerated in a flotation cell by agitation in the presence of a stream of air or by blowing air in fine streams through the slurry; and (4) The aerated particles in the froth are withdrawn from the top of the cell as an overflow froth product, and the remaining solids and water are discharged from the bottom of the flotation cell.

Much scientific endeavor has been expended toward analyzing the various factors which relate to improving the conditions during flotation in order to obtain improved recovery of particles. One particular phenomenon that has been known for some time is the poor flotation response of fine particles. This becomes economically important when flotation separation methods are used in the processing of minerals.

Generally, prior art processes have achieved flotation for both metallic and nonmetallic minerals having particle sizes as large as about 1000 microns. In these processes, particles less than 10 to 100 microns in size (depending on the particular mineral sought to be recovered) are frequently difficult to recover.

One factor which is in large part determinative of this lower size limit and which has limited the extent of fine particle recovery is the relatively slow rate at which fine particles are separated in the prior art flotation processes. Frequently, the mineral industries have thus been forced to discard the smaller, unrecovered mineral particles since it is uneconomical to concentrate or recover them.

The economic losses suffered by the mineral industries due to this inability to recovery very fine minerals by conventional flotation techniques is staggering. For example, in the Florida phosphate industry, approximately one-third ($\frac{1}{3}$) of the phosphate is typically lost in the residuel waste slime. Roughly, one-fifth (1/5) of the world's tungsten and about one-half ($\frac{1}{2}$) of Bolivian tin is lost due to the inefficiencies of the present flotation techniques used in recovery processes for these minerals.

The inability of prior art flotation processes to recover fine particles is also important in the coal industry. Flotation processes for separating ash and sulphur from coal have been used with greatly increased frequency during recent years. However, in these flotation separation processes, significant amounts of very fine coal particles go unrecovered. As a result, coal fines may be lost in the reject stream. Not only is this a waste of a valuable resource, but disposal of coal-containing reject streams is frequently a serious environment problem.

Another factor which further complicates the effectiveness of conventional flotation is that conventional flotation cells generally require a minimal retention time of at least two minutes for successful separation. This is particularly disadvantageous because such relatively long retention times required for conventional flotation processes limit plant capacity and necessitate the construction of extremely large equipment which has large floor space demands and requires tremendous capital and maintenance expenditures.

B. Froth Problems Encountered In The Prior Art Flotation Processes Conducted in a Centrifugal Field Efforts to provide an improved flotation process have resulted in apparatus and methods which achieve flotation in a centrifugal field. For example, flotation has been conducted in a hydrocyclone-type device, yielding greatly improved flotation results over other prior art flotation apparatus. In such hydrocyclone systems, one very important factor is the formation and maintenance of a stable froth.

For example, once the bubble/particle aggregates formed in the hydrocyclone have been collected into a froth, interaction between the froth and the fluid flow within the cell can cause the destruction of a portion of the froth which has been formed. The result is that the amount of froth and mineral product recovered can be significantly reduced.

In prior art hydrocyclones, one region which typically experiences significant undesirable mixing between the fluid flow and the froth, is the point where fluid discharge is removed from the flotation cell. Another obvious point of interaction is the boundary layer between the froth and the fluid flow within the hydrocyclone. Any hydrocyclone apparatus or method which could minimize the mixing between the froth and the fluid flow experienced in the prior art, would be a significant advancement in the art.

Attempts to minimize froth destruction have typically resulted in systems which do not achieve the desirable level of collision and attachment of bubbles and particles. Prior art flotation cells have, therefore, not been designed in such a manner as to minimize froth disruption and yet promote collisions of bubbles and particles. This results in a compromise between the high intensity of agitation necessary for reasonable collision rates and the low intensity of agitation necessary to preserve the bubble/particle aggregates once formed. Attempts to reach such a compromise have resulted in the installation of intricate baffling systems in some prior art flotation apparatus to separate mixing zones from settling zones. Any apparatus which could minimize the interaction between the froth and fluid flow and still maintain high rates of collision so as to optimize bubble/particle attachment would thus be a significant advancement in the art.

Another problem experienced in the prior art is the problem of controlling the water split in the froth product. The water split may be defined as the ratio of the amount of water in the particle-containing froth product to the amount of water initially in the particulate suspension. Accordingly, it will be appreciated that low water splits are the most desirable provided that sufficient transport of hydrophobic particles to the overflow concentrate product can be sustained.

Mixing between the fluid discharge and the froth within a hydrocyclone results in disadvantageously high water splits characterized by a relatively high amount of water in the froth. Moreover, it has been shown that high water splits are typically characteristic of poor flotation separation because a high proportion of fine gangue particles associated with the mineral to be treated are entrained by the water into the froth. Thus, any hydrocyclone apparatus or method which could allow the water split to be carefully controlled would be an advancement in the art.

It would, therefore, be a significant advancement in the art to provide a flotation method and apparatus which minimize mixing between the fluid flow and the froth within the flotation vessel so as to maintain a more stable froth within the vessel, while preserving the recent advancements in the art with regard to the flotation of relatively fine particles and relatively rapid flotation rates. It would be another advancement in the art to provide flotation methods and apparatus wherein the water split may be carefully controlled, with good transport of hydrophobic particles and froth to the overflow product. Such an apparatus and methods are disclosed and claimed herein.

BRIEF SUMMARY AND OBJECTS OF THE INVENTION

The present invention relates to air sparged hydrocyclone flotation apparatus and methods wherein bubble/particle aggregates are formed to be extracted from the upper end of the flotation vessel and wherein fluid discharge is removed annularly from the flotation vessel. Preferably, the apparatus comprises a generally vertically oriented, cylindrical flotation vessel having an inlet at the upper end (tangential to axis of the flotation vessel) for introducing a particulate suspension into the vessel in a generally tangential fashion. The vessel also includes an annular outlet at the lower end for directing fluid discharge from the particulate suspension out of the vessel in a generally annular fashion which minimizes the disturbance of the centrifugal flow of the fluid discharge.

The apparatus further includes a pedestal positioned within the vessel. Some embodiments of the invention include a conical pedestal extending from the lower end of the vessel adjacent the annular outlet upwardly into the upper half of the vessel. The annular outlet comprises an annular gap defined by the space between the pedestal and the inner surface of the wall of the vessel.

The configuration of the flotation vessel, with its tangential inlet and annular outlet, directs the particulate suspension around the vessel in a swirling motion such that the particulate suspension forms a swirl layer of suspension around the inner surface of the vessel wall. The configuration also directs the flow of the particulate suspension so as to create a forced vortex in the vessel; the forced vortex, in turn, forms a centrifugal field.

A portion of the vessel wall is preferably formed as a porous wall, and the porous wall is surrounded by a gas plenum in communication with a gas source. Moreover, the pedestal mounted in the flotation vessel directs fluid discharge out of the vessel while supporting the froth column forced therein and while minimizing mixing between the froth and the fluid discharge, which mixing would cause destruction of the froth.

In the operation of the present invention, the particulate suspension is first introduced into the vessel through the tangential inlet and forms a swirl layer of suspension against the inside surface of the wall of the vessel. Gas inside the gas plenum is then injected through the porous wall and into the swirl layer of particulate suspension within the vessel.

The air bubbles and hydrophobic particles within the fluid suspension form bubble/particle aggregates which float to the "top" of the centrifugal force field, i.e., the axial center of the vessel. The bubble/particle aggregates thus congregate at the core of the vessel to form a froth column which is removed coaxially through a vortex finder positioned at the top of the vessel.

As gas is sparged through the porous wall into the swirl layer of particulate suspension, very small air bubbles are formed by the high shear velocity of the particulate suspension against the porous wall. As the gas bubbles form at the porous wall, they are met by the directed flow of the particulate suspension so as to increase the collision rate between the gas bubbles and the particles in the particulate suspension.

After formation and separation of the bubble/particle aggregates, the remaining fluid exits the annular outlet as discharge, with the annular outlet providing for smooth exit of the suspension and swirl flow from the vessel so as to avoid interaction between the fluid discharge and the froth column within the vessel. At the bottom region of the vessel where the fluid discharge exits the annular outlet, the pedestal prevents mixing between the froth and the exiting fluid discharge in order to maintian the structural stability and integrity of the froth column.

Because of the annular fluid discharge and froth pedestal features of the present invention, as well as the forced vortex achieved in the present invention, the froth within the vessel is maintained as a stable froth. Additionally, regulation of the diameter of the froth pedestal allows the water split to be controlled. Moreover, because of the swirl layer in which flotation occurs, flotation is achieved rapidly, and the retention time for the separation process within the vessel is on the order of seconds, rather than on the order of minutes.

It is, therefore, an object of the present invention to provide flotation apparatus and methods wherein the stability and integrity of the froth column are better established and maintained than in the prior art processes.

Another object of the present invention is to provide flotation apparatus and methods wherein a pedestal is positioned within the vessel so as to minimize interaction and mixing between the fluid flow and the froth within the vessel.

A further object of the present invention is to provide flotation apparatus and methods wherein the fluid discharge is removed from the vessel in a generally annular fashion so as to provide for smooth fluid discharge from the vessel and to minimize mixing between the fluid flow and the froth within the vessel.

Still another object of the present invention is to provide flotation apparatus and methods wherein the fluid flow forms a forced vortex so as to enhance the formation of a stable froth with a minimum amount of water, thereby allowing for careful control of the water split and the transport of hydrophobic particles as the overflow concentrate product.

Yet another object of the present invention is to provide flotation apparatus and methods which achieve flotation separation of fine particles which are at least as small, if not smaller than, particles separated by prior art processes, and wherein such flotation separation is achieved much more rapidly than in prior art processes.

These and other objects and features of the present invention will become more fully apparent from the following description and appended claims, taken in conjunction with the accompanying drawings.

DETAILED DESCRIPTION OF THE PREFERRED EMBODIMENTS

Reference is now made to the drawings wherein like parts are designated with like numerals throughout. It will be readily appreciated that the components of the present invention as generally described and illustrated in the figures herein could be arranged and designed in a wide variety of different configurations. Thus, the following more detailed description of the preferred embodiments of the apparatus and method of the present invention, as represented in the figures, is merely representative of many possible embodiments of the present invention.

Figure 1:
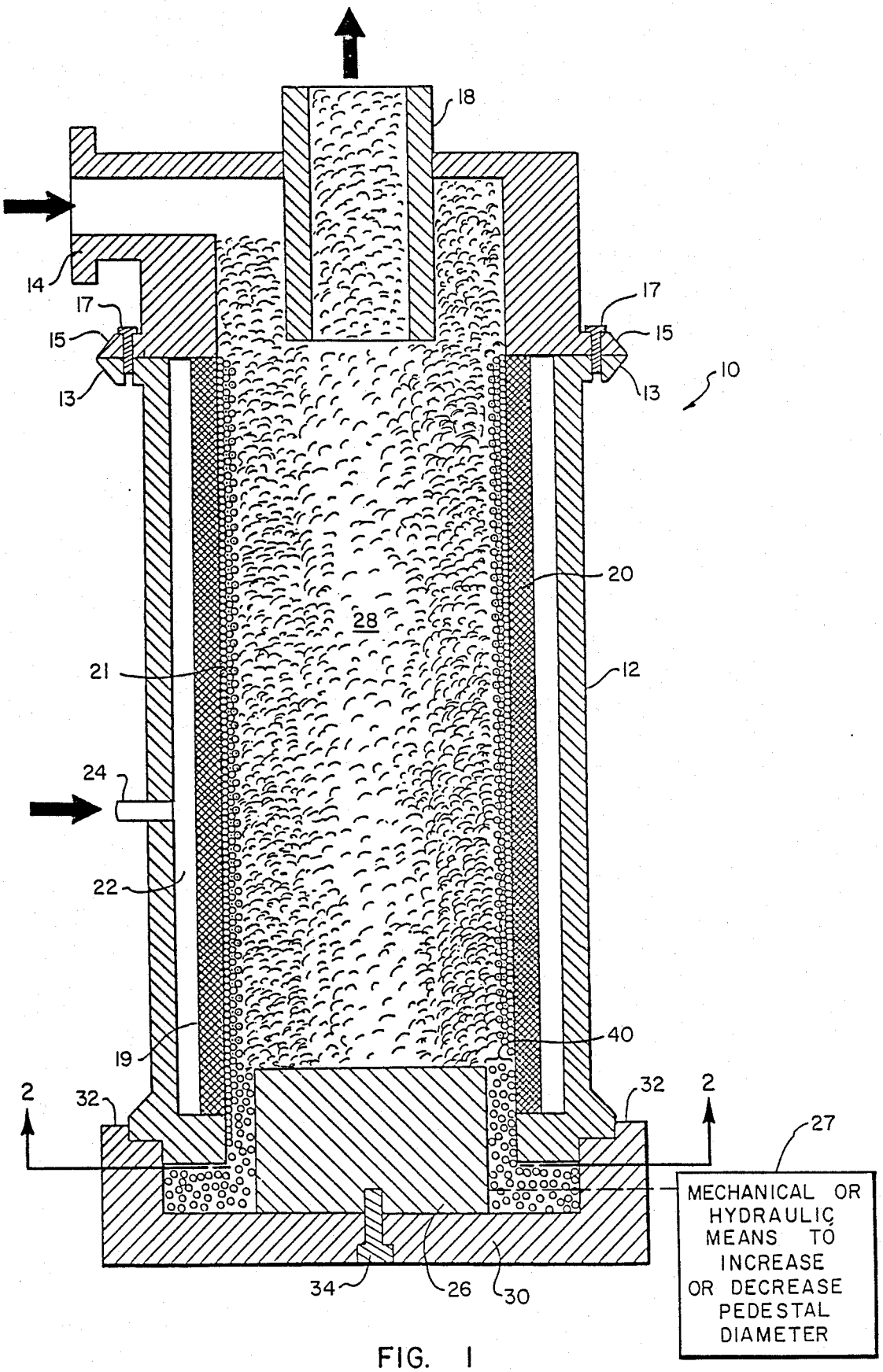
FIG. 1 is a vertical cross-sectional view of a first presently preferred embodiment of the present invention.
Figure 2:
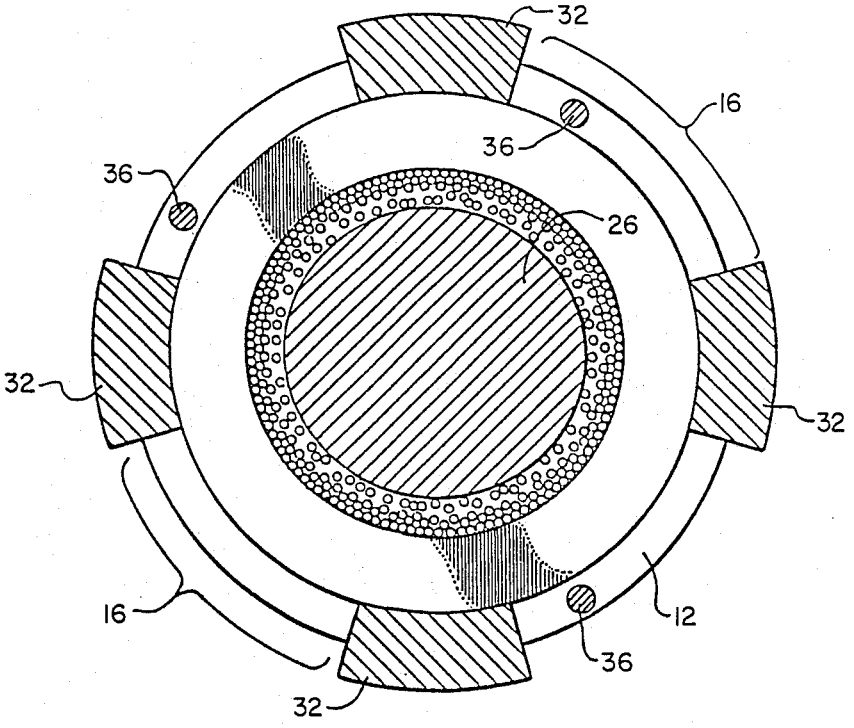
FIG. 2 is a horizontal cross-sectional view of the embodiment of FIG. 1 taken along line 2—2.

With specific reference to FIGS. 1 and 2, the first presently preferred embodiment of the present invention is illustrated. The flotation apparatus, generally designated 10, includes a generally cylindrical housing or vessel 12 which is preferably vertically oriented. Housing 12 may be formed as an upper portion and a lower portion which are joined at flanges 13 and 15 by one or more bolts 17. A generally tangential inlet 14 is formed at the upper end of cylindrical flotation vessel 12 for receiving a particulate suspension, also sometimes referred to as a "slurry feed."

A generally annular outlet is formed at the lower end of vessel 12 for directing fluid discharge from the particulate suspension out of vessel 12 in a generally annular fashion. In the embodiment of FIG. 1, the annular outlet comprises an annular gap 40 formed between a froth pedestal 26 and the inner wall of vessel 12, with the peripheral discharge passageways 16 (FIGS. 2) formed between pedestal support 30 and the lower end of vessel 12 providing for final removal of the fluid discharge from vessel 12. Additionally, vessel 23 may be secured to pedestal support 30 by any suitable means, for example by the use of connecting bolts 36 as shown in FIG. 2.

A portion of the wall of vessel 12 is preferably formed as a porous wall 20, having an outer surface 19 and an inner surface 21. An annular gas plenum 22 is formed between housing 12 and porous wall 20, with gas inlet 24 being formed in housing 12 to provide gaseous communication between a gas source (not shown) and gas plenum 22. a generally cylindrical vortex finder 18 is mounted to the upper end of flotation vessel 12. Vortex finder 18 is hollow to permit the passage of froth therethrough.

As shown best in FIG. 1, positioned within the lower end of vessel 12 is froth pedestal 26 for supporting a froth column 28 which is formed during the operation of apparatus 10. Froth pedestal 26 is preferably mounted to pedestal support 30 (such as by bolt 34), and the pedestal is centered within the lower end of vessel 12 by engaging a series of centering arms 32 (FIG. 2) formed around pedestal support 30 with the lower end of vessel 12.

As shown in FIG. 2, centering arms 32 ensure the proper centering of froth pedestal 26 within vessel 12. As will be appreciated from the discussion hereinafter, centering of the pedestal within the vessel is important to minimizing the mixing between the froth and the fluid flow within the vessel and thus important to the optimum operation of flotation apparatus 10. In this arrangement, peripheral discharge passageways 16 are defined by the space between pedestal support 30 and the lower end of vessel 12.

By referring to FIGS. 1 and 2, the operation of flotation apparatus 10 and one preferred embodiment of the method of the present invention can best be understood. A particulate suspension containing finely divided particles is introduced into vessel 12 through tangential inlet 14 so as to assume a swirling flow path around inner surface 21 of porous wall 20. The particulate suspension is introduced under pressure so as to create a relatively strong centrifugal force field.

Figure 4:
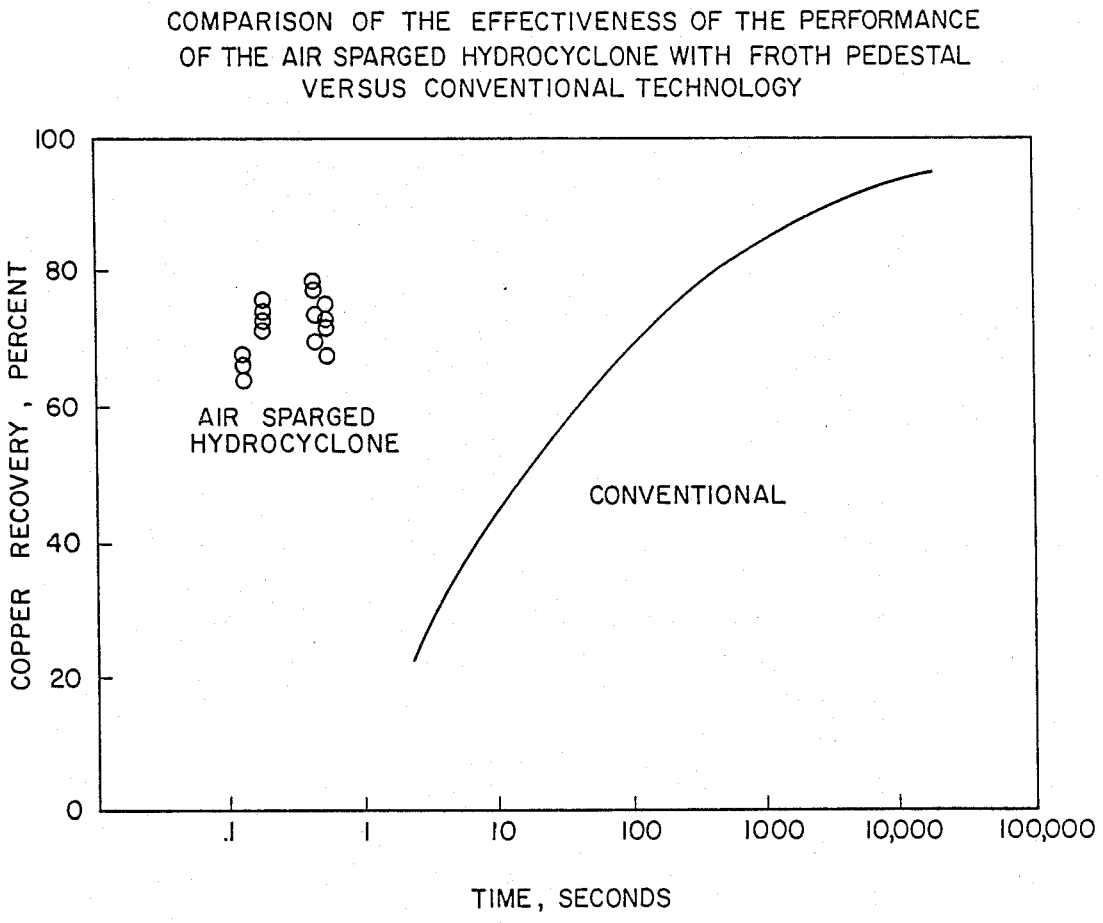
FIG. 4 is a graph comprising the experimental flotation rate and recovery using the apparatus and method of the first embodiment versus a conventional flotation processes.

In certain experiments (the results of which are shown in FIG. 4 and discussed in more detail hereinafter), the particulate suspension was introduced into a flotation vessel having a 4.7 cm diameter at a feed rate because about 10 and about 16 gallons per minute, producing centrifugal force fields in the range from about 70 G to about 200 G. It is anticipated that centrifugal force fields which are smaller or larger than these values may also be employed in the present invention; these values are given by way of example only and not by way of limitation.

The particulate suspension contains one or more particulate constituents to be separated. The particulate constituents to be separated should either be naturally hydrophobic or rendered hydrophobic by the addition of a promoter or collector or by other methods known in the art. Other particles which may be present in the particulate suspension, and which are not desired to be recovered, should be left hydrophilic.

After tangentially injecting the particulate suspension into inlet 14 under pressure so as to impart a swirling motion to the particulate suspension, the particulate suspension forms a swirl layer against inner surface 21 of porous wall 20. Gas (e.g., air or any other gas which will not react adversely with the particulate suspension) is introduced through gas inlet 24 into gas plenum 22 and through porous wall 20 into the swirl layer of particulate suspension against surface of porous wall 20.

Upon entry into the swirl layer of particulate suspension, the gas forms small bubbles which attach to and/or entrain the hydrophobic particles and transport them in the centrifugal field to the axial center of vessel 12. The hydrophilic particles do not attach to the gas bubbles and follow the swirl flow of the swirl layer in the centrifugal field along the inner surface 21 of porous wall 20.

The hydrophilic particles follow the swirl layer of particulate suspension downwardly and leave the vessel 12 annularly with the fluid discharge through annular outlet 16. The hydrophobic particle/bubble aggregates congregate at the core of vessel 12 to form a froth column 28. The froth column, which is supported by froth pedestal 26, travels upwardly through vessel 12, and is discharged from the vessel through vortex finder 18.

In this regard, it will be noted that a particulate constituent can be recovered from a particulate suspension by the flotation techniques of the present invention even though that particular constituent comprises particles having a broad range of particles sizes and even though there may be other particulate constituents in the particulate suspension which are smaller or within the same range of particle sizes.

Within the swirling layer of fluid within vessel 12, a mass gradient exists because of the centrifugal force field created within the vessel. The region closest to porous wall 20 contains mostly water, whereas the region nearest the core of vessel 12 contains mostly gas bubbles. The particles contained within the particulate suspension are distributed within the swirling fluid layer based on their density, size, shape, and interaction with air.

Hence, the large hydrophilic particles are forced towards porous wall 20, while the small hydrophilic particles are distributed throughout the swirl layer according to their mass. Hydrophobic particles form particle/bubble aggregates and thus migrate towards the core of vessel 12.

The removal of the fluid discharge from vessel 12 through the annular outlet occurs in a very smooth fashion due to the annular configuration of gap 40 and the peripheral location of passageways 16. Since the centrifugal flow of swirling fluid within vessel 12 moves around the inner circumference of the vessel, peripheral discharge passageways 16 provide a natural escape for the fluid discharge, thereby allowing the fluid discharge to exit the vessel without disrupting fluid flow within the vessel.

Additionally, such smooth discharge avoids the pooling or accumulation of fluid discharge within the bottom of the vessel which is a cause for disruption of the fluid flow in such prior art apparatus as the hydrocyclone. Importantly, the smooth centrifugal flow of fluid within vessel 12 and the smooth exiting of fluid discharge from the vessel cause minimal disturbance of froth 28, thereby preserving the stability, quiescence, and integrity of the froth.

From the foregoing, it will be recognized that the term "annular outlet" as used herein thus refers to an outlet which allows for smooth exit of the fluid discharge from vessel 12 without substantial disruption of the fluid flow within the vessel. As discussed previously, the "annular outlet" of the embodiment of FIG. 1 comprises annular gap 40, with peripheral discharge passageways 16 providing for final removal of the fluid discharge from vessel 12.

Although in FIG. 2 peripheral discharge passageways 16 are shown forming an interrupted circular pattern, the configuration of the passageways 16 may be modified to achieve minimum disruption of fluid flow within the vessel in a given particular application of the present invention. Thus, it will be appreciated that the present invention may contemplate the presence of structural support members such as centering arms 32 shown in FIG. 2 which may partially obstruct the peripheral discharge to form passageways 16. Indeed, the present invention could even comprise a series of tangential outlets around the periphery of the vessel bottom, defined by a plurality of support members or dividing members mounted to the vessel bottom.

Figure 3:
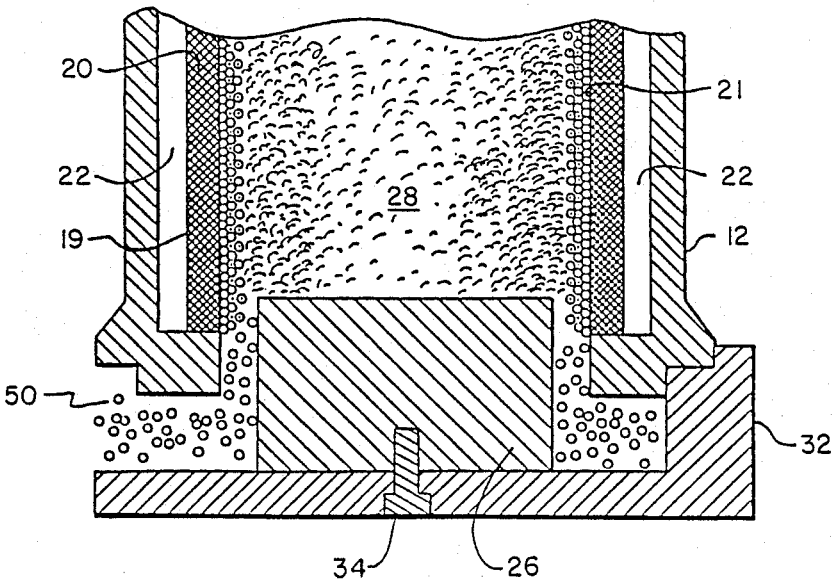
FIG. 3 is a partial cross-sectional view of a second presently preferred embodiment of the present invention.

A second embodiment of the present invention is illustrated in FIG. 3. This embodiment is similar to the preferred embodiment of FIGS. 1 and 2, except that a tangential discharge passageway 50 is used in lieu of peripheral discharge passageways 16. Thus, in the embodiment of FIG. 3, the "annular outlet" is defined by annular gap 40, with tangential discharge passageway 50 providing for final removal of fluid discharge from vessel 12. This embodiment operates similarly to the preferred embodiment of FIGS. 1 and 2, except that the fluid discharge is removed through tangential discharge passageway 50 instead of peripheral discharge passageways 16.

Referring now more particularly to FIGS. 1 and 2, cylindrical froth pedestal 26 acts to further direct the fluid discharge through the annular outlet in a smooth fashion. The vertical surface area around cylindrical froth pedestal 26 defines annular gap 40 with the wall of vessel 12 and provides a guide for directing the fluiid discharge through gap 40.

Moreover, the froth pedestal supports froth column 28 at a distance well away from the fluid discharging through peripheral discharge passageways 16. Upon entering annular gap 40, the fluid discharge becomes isolated from froth 28 while the froth remains supported at the top horizontal surface of froth pedestal 26. Thus, froth pedestal 26 acts to minimize mixing between froth 28 and the fluid discharge, thereby preserving the stability and integrity of froth 28.

Advantageously, froth pedestal 26 may be configurated so as to enable one to increase or decrease its diameter. This may be accomplished, for example, by constructing pedestal 26 of flexible material which may be mechanically or hydraulically expanded and contracted so as to effectively increase or decrease the diameter of pedestal 26. Alternatively, the diameter of froth pedestal 26 may be "adjusted" by removing bolt 34, replacing the existing froth pedestal with one of a different diameter, and inserting bolt 34 back into position so as to anchor the new froth pedestal to pedestal support 30.

There are many advantages to configuring froth pedestal 26 so as to have an adjustable diameter. For example, the water split can be manipulated and carefully controlled by changing the diameter of the froth pedestal. When the diameter of the froth pedestal is smaller, less material is transported to froth 28 in the overflow exiting vortex finder 18, thus resulting in a lower water split.

Thus, by adjusting the diameter of froth pedestal 26, one can select the portion of the mass gradient within vessel 12 which is to be forced upwards with froth 28 into the overflow. With a relatively small diameter, froth pedestal 26 will allow only relatively low mass material, e.g., air bubbles, bubble/particle aggregates, and fine hydrophilic particles, to be transported to the overflow via froth 28. With a relatively large diameter, froth pedestal 26 intersects the mass gradient closer to porous wall 20, thereby forcing material of relatively high mass into the overflow via froth 28.

Small cylindrical pedestal diameters (with constant vessel diameters) tend to yield higher grade products with lower recoveries, while larger pedestals result in high recoveries with relatively low grades. Thus, the trade off between recovery and grade can be determined experimentally by varying the size of froth pedestal 26 in a given application, thereby allowing greater flexibility in achieving the desired amount and the desired ratios of the water and the particulate constituents in the overflow, as compared to prior art processes.

It will be recognized that froth pedestal 26 may also assume shapes other than cylindrical and may be configurated of varying heights, from pedestals shorter than that illustrated in FIG. 1 to pedestals taller than that illustrated in FIG. 1, as will be explained shortly. Some of the important characteristics of the froth pedestal are support for the froth column and an outlet means which are provided between the froth pedestal and the vessel.

Additionally, froth pedestal 26 may be rotatably mounted to pedestal support 30 such that pedestal 26 is free to rotate around the axis of cylindrical vessel 12. Moreover, driving means (not shown) may be provided to rotate froth pedestal 26. Rotation of froth pedestal 26 may have several desirable effects which will be mentioned later in this disclosure.

Moreover, froth pedestal 26 may be configurated with a spring-loaded system which would allow the pedestal to be partially ejected through a hole formed in pedestal support 30 to relieve any pressure buildup within annular gap 40. Thus, if annular gap 40 becomes plugged with particles during operation, the pressure buildup would cause pedestal 26 to be pushed downwardly through the hole in support 30 so as to permit flushing of the material clogging annular gap 40. Alternatively, such a flushing feature could be provided by hydraulically actuating froth pedestal 26 in lieu of using a spring-loading system.

The apparatus and methods of the present invention further serve to maximize the attachment of the hydrophobic particles in the particulate suspension to the gas bubbles. By maximizing the attachment of the hydrophobic particles to the air bubbles to form bubble/particle aggregates, the degree of separation of the hydrophobic particles from the particulate suspension is increased.

This maximization of the formation of bubble/particle aggregates is due in part to the fact that flotation occurs in a centrifugal field, where the probability of collision and subsequent attachment of the gas bubbles to hydrophobic particles is greatly enhanced. Thus, the present invention takes full advantage of the affinity of the hydrophobic particles for the gas bubbles in achieving maximal separation of the hydrophobic particles.

It will be appreciated that the same apparatus and method may be used to separate finely divided hydrophobic particles, or finely divided particles which are made hydrophobic, from a particulate suspension containing no other particles. In such an application, there are, of course, no hydrophilic particles in the fluid discharge. For example, the present invention may be used in sulfur recovery processes or in the treatment of waste water.

There are several other significant advantages associated with the novel apparatus and methods of the present invention. For example, the generally tangential orientation of inlet 14 and the generally annular configuration of the annular outlet cause the injected particulate suspension to form a forced vortex within vessel 12 such that the forced vortex creates a centrifugal field.

In a forced vortex system, the whole fluid system rotates at the same angular velocity. Hence, a forced vortex system results in a wheel-like motion with the tangential velocity of the fluid decaying to zero in the direction of the axial center of the apparatus. In a free vortex system, however, the tangential velocity is maximal at an intermediate distance from the center of the apparatus. Consequently, a more stable froth is more easily formed and maintained in a forced vortex system than in a free vortex system.

Another advantage of the present invention is the careful control over the water split which is achieved. As mentioned previously, it is highly desirable to minimize the water split, thereby minimizing the amount of water in froth 28 and the amount of water carried with the desired product to the overflow. From the discussion herein, it will be appreciated that the water split can be controlled in the present invention by adjusting the diameter of froth pedestal 26.

Another important factor to controlling the water split as achieved in the present invention is the separation of froth 28 from the fluid discharge by froth pedestal 26. As mentioned above, the froth pedestal minimizes the mixing between the fluid discharge and the froth at the point of discharge from the vessel, and it serves to keep froth 28 at a significant distance from the fluid discharge exiting the annular outlet. Because of these functions of the froth pedestal, the amount of water communicated from the fluid discharge to froth 28 is minimized.

Moreover, the annular outlet also contributes significantly to controlling the water split as achieved in the present invention. Removing the fluid discharge annularly from vessel 12 results in even less interaction between the fluid flow and the froth within the flotation vessel; thus, even less water is entrained in the froth and carried to the overflow by the froth column.

Another important factor involved in controlling the water split is the generally cylindrical configuration of vessel 12 and the tangential orientation of inlet 14, in combination with the annular configuration of the annular outlet. A tangential inlet and annular outlet assure that the particles in the particulate suspension will be subjected to sufficient centrifugal forces to minimize the entrance of water into the froth.

The vertical orientation of the flotation vessel helps to maximize the drainage of fluid from froth column 28 as it moves upwardly in a vertical direction. In addition, the vertical orientation of the flotation vessel utilizes gravity to its maximum extent to act on the water in froth column 28.

As the bubble/particle aggregates reach the core of vessel 12, they congregate to form froth 28 which is directed upwardly by froth pedestal 26 towards vortex finder 18. Froth 28 then exits vessel 12 through the vortex finder. Since froth 28 travels countercurrently to the swirl layer of particulate suspension and since the vessel 12 is vertically oriented, water drainage from froth 28 is further enhanced by the generally vertical orientation of flotation vessel. The result is even further minimization of the water split (i.e., the amount of water in the froth product).

The "thickness" of the swirl layer may vary greatly depending upon the feed material and the particular operating parameters of the embodiment. For example, in some applications the swirl layer may occupy less than 10% of the volume of the vessel. In other applications the swirl layer may occupy much more of the vessel's internal volume.

There are several advantages which result from the formation of the swirl layer of particulate suspension adjacent the porous wall in the present invention. As gas is introduced from gas plenum 22 through porous wall 20 and into the swirl layer of the particulate suspension, small air bubbles are formed along the inner surface 21 of porous wall 20.

The high shear velocity of the swirl layer of the particulate suspension against inner surface 21 of porous wall 20 creates a continual generation of very small gas bubbles and provides for intense contact between the hydrophobic particles and the gas bubbles within the swirl layer. It will be understood that the generation of the large number of very small gas bubbles is due, in large measure, to the high shear velocity of the swirl layer of particulate suspension against porous wall surface 21.

Another important factor in achieving the generation of a large number of small gas bubbles in the pore size of the pores formed in porous wall 20. Presently, pore sizes in the range from about 5 to 100 microns have been found to yield satisfactory results in terms of producing small gas bubbles. It is anticipated, however, that pore sizes outside this range may also be suitable to produce the voluminous quantities of small gas bubbles needed.

Moreover, during formation of the gas bubbles at porous wall 20, the particulate suspension is directed towards the gas bubbles, thereby causing intense interaction between the bubbles and the particles. The intense interaction between bubbles and particles caused by the directed motion of the particulate suspension towards the gas bubbles, together with the high shear velocity of the particulate suspension against porous wall 20, considerably increases the probability of collision between the gas bubbles and the hydrophobic particles in the swirl layer of particulate suspension.

In conventional flotation cells, gas bubbles and particles are mixed together at random, and the probability that a particle and bubble will met with sufficient velocity to form a particle/bubble aggregate is considerably less than the probability that such an occurrence will take place in the swirl layer system of the present invention.

Additionally, since in many applications the swirl layer of the present invention generally occupies a low percentage of the volume of vessel 12, flotation is achieved rapidly. This is because the gas bubbles need only arrive at the boundary between the swirl layer and froth 38 before flotation is complete. Indeed, flotation can be achieved 50 to 100 times, and sometimes as much as 300 times, faster in the present invention than in most conventional flotation cells.

For example, the present invention has been used to achieve flotation of about 80% of the copper sulphide in a copper porphyry ore sample in about one second or less. (See the experimental results reported in Exmaple 1, discussed in more detail hereinafter.) Prior art processes typically require about 10 to 15 minutes for such a separation.

It will be appreciated that the annular outlet accommodates the maintenance of the swirl layer of particulate suspension, by permitting discharge in a manner and at such a rate that does to not disturb the swirl layer. Since the centrifugal flow of the swirl layer within vessel 12 moves around the inner circumference of the vessel, annular gap 40 and peripheral discharge passageways 16 provide for the smooth exit of fluid discharge from the vessel, without disturbing the swirl and without pooling in the bottom of the vessel.

Moreover, froth pedestal 26 also serves to accommodate the swirl layer by directing the fluid discharge smoothly out of vessel 12. In particular, annular gap 40 between froth pedestal 26 and vessel 12 is, in most applications, slighly larger than the swirl layer and serves to accommodate the swirl layer and direct it towards peripheral discharge passageways 16. The width of this gap 40 may be changed by adjusting the diameter of froth pedestal 26 as explained hereinabove. Thus, annular gap 40 may be adjusted according to the particular width of the swirl layer within vessel 12.

As mentioned previously, the retention time of the particulate suspension, (i.e., the time that it enters inlet 14 to the time the fluid discharge exits peripheral discharge passageways 16), is a matter of seconds, thus providing for a much more rapid separation than is achieved in most conventional flotation cells. This feature, in turn, allows embodiments of flotation apparatus 10 to be constructed which are much smaller than conventional flotation cells, thereby eliminating the need to set aside a large floor space to operate the apparatus.

It will also be appreciated that the retention time is influenced by the length of porous wall 20 and the air flow rates of the gas sparged therethrough. Consequently, porous wall 20 may be constructed with a length that will provide the most desirable retention time for a given application.

EXAMPLE 1

The rapid flotation rates achieved by the present invention, as compared to flotation rates of prior art processes, are graphically illustrated in FIG. 4. The comparative data graphed in FIG. 4 presents a comparison of the performance of an air-sparged hydrocyclone (with cylindrical froth pedestal) of the type illustrated in FIG. 1 with the performance that would be expected to be obtained in a conventional continuous flotation cell (as predicted by an analysis of twenty batch flotation tests). The one slurry used in this comparative testing was prepared using a typical western copper porphyry ore.

The data in FIG. 4 for a typical conventional flotation process is based upon a series of batch flotation tests using a five liter Galligher flotation cell having a 10.5 centimeter impeller agitator. The impeller was operated at about 700 rpm, and the air flow gas was about 9 standard liters per minute (slpm). Head analyses of the ore used in these tests showed a copper content in the range of about 0.58 to 0.72%. The fineness of the ore varied in the tests in the range of about 58.4 to 66.5% not passing 400 mesh.

The reagents used during the batch flotation tests included lime, sodium cyanide ("NaCN"), kerosene, and a frother (Dowfroth 1012). Lime was added such that the pH was about 8.8; the amounts of the other reagents varied within the following parameters:

NaCN—0.015–0.030 lb/ton
Frother—0.68–2.32 lb/ton
Kerosene—0.8 lb/ton

A collector was added to the slurry in an amount of about 0.05–0.08 lb/ton. The slurry contained between about 8.9–9.8% solids and was conditioned for between about five (5) and fifteen (15) minutes prior to the initiation of a test. Samples of the concentrate were taken at 20, 60, 180, and 360 seconds after the introduction of the air. The concentrate samples were analyzed and the results were extrapolated so as to represent the results which would be obtained in a continuous flotation device.

The curved line in FIG. 4 indicates the maximum test results which were obtained. The percent of copper recovery is plotted versus the flotation time necessary to achieve that recovery; note that the time is plotted exponentially. These results are consistent of the expected behavior of such a copper porphyry ore in large industrial flotation equipment.

The data reported in FIG. 4 for the performance of the air-sparged hydrocyclone with a cylindrical froth pedestal were obtained on an apparatus such as illustrated in FIG. 1. The air-sparged hydrocyclone had a diameter of about 4.7 cm and a length of between about 40.5 cm and about 96.5 cm (depending upon the particular test). The pedestal diameter was varied between 4.27 cm and 4.32 cm.

Head analyses of the ore used in these tests showed a copper content in the range of about 0.48–0.70%. The fineness of the ore varied in the tests in the range of about 55.12–68.4% not passing 400 mesh. The conditioning reagents were the same as with the previous tests except that the amounts used varied within the following parameters:

NaCN—0.021–0.025 lb/ton
Frother—1.4–1.7 lb/ton
Kerosene—0.72–0.85 lb/ton

The slurry was then conditioned for about five (5) minutes prior to the initiation of a test. A collector was added to the slurry in an amount of about 0.0–0.08 ml/kg.

The slurry, having between about 5.2 and 11.3% solids, was then pumped into the air-sparged hydrocyclone apparatus at a slurry feed rate of between about 75 and 160 lb/min; this correspondence to between about ten and sixteen gallons of slurry per minute through the 4.7 cm diameter air-sparged hydrocyclone. (The resultant centrifugal forces were calculated to be in the range of about 70–200 G.) The air flow rate was between about 4.3 and 8.5 SCFM.

As illustrated in FIG. 4, high recovery rates were achieved in very short time periods. What is particularly noteworthy is that the difference in the residence time in the flotation apparatus of the present invention was about three orders of magnitude at a recovery of 70–80% with comparable grades. The copper grade (weight percent copper in the concentrate) was about 3.9–10.6% in the air-sparged hydrocyclone of the present invention and about 2.9–6.9% in the conventional apparatus.

Figure 5:
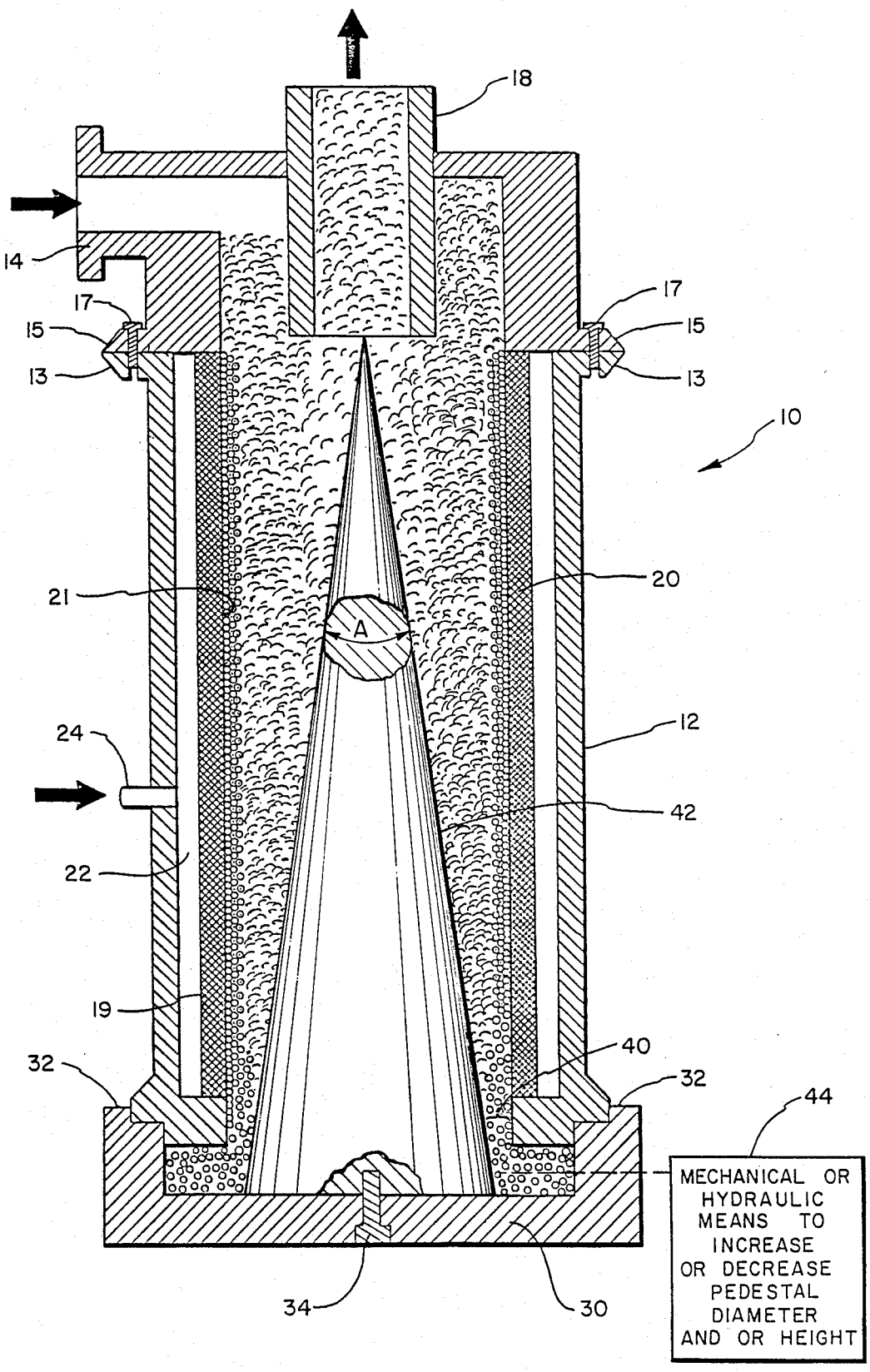
FIG. 5 is a vertical, partially cross-sectional view of a third presently preferred embodiment of the present invention incorporating a conical pedestal.

A third presently preferred embodiment of the present invention is illustrated in FIG. 5. Except those which will be specifically noted, nearly all of the structures of the illustrated third embodiment are similar or identical to the structures utilized in the two previously described embodiments. Such similar or identical structures are provided with the same reference numerals in FIG. 5 as those provided in the previously discussed figures.

Importantly, the embodiment illustrated in FIG. 5 is provided with conical pedestal 42 rather than cylindrical pedestal 26 as shown in FIG. 1. Also, the third embodiment may be provided with a means for increasing or decreasing the diameter and the heigth of conical pedestal 42 as represented by box 44 in FIG. 5.

For example, the height and diameter may be changed by replacing a first pedestal with a second pedestal. Alternatively, a hydraulic mechanism may be provided to alter the distance which conical pedestal 42 extends into the vessel thus altering its height in the vessel. Importantly, altering the height of the conical pedestal also varies the size of the annular opening 40.

Conical pedestal 42 is attached at its base to pedestal support plate 30 and extends from the lower end of vessel 12 (adjacent annular outlet 40) to vortex finder 18 located at the upper end of vessel 12. As used herein, when the length or height at which a pedestal extends into vessel 12 is specified, it is to be assumed that the measurement is taken in relation from the top of the annular outlet to the lower edge of the vortex finder.

While the height at which conical pedestal 42 extends upwardly into vessel 23 may be altered (either by manually replacing pedestal 42 or by mechanical or hydraulic means 44), when a generally conical pedestal is incorporated into embodiments of the present invention it will generally extend from the annular outlet upwardly to at least one-half the length of the vessel (i.e., one half the distance to the vortex finder).

Also, it will be appreciated that when pedestal 42 is configured as a true cone, increasing or decreasing the diameter found at the base of the pedestal will increase or decrease the angle found at the apex of the pedestal. The apex angle is represented at Angle A in FIG. 5.

Alternatively, in some applications, pedestal 42 may not possess a true conical shape but will be generally conical and may be provided with diameters which do not decrease linearly from the lower end to the upper end of the pedestal. Furthermore, in some applications it may be desirable to include fluid directing structures on the outer surface of the conical pedestal. Embodiments including such structures are discussed in greater detail hereinafter.

When pedestal 42 is configured as a smooth cone (i.e., linearly decreasing diameters upwardly along the axis of the cone) it is generally preferred that the apex of pedestal 42 be provided with an angle in the range from about 4° to about 30° with the most preferred range being from about 5° to about 20°. The considerations to be weighed when determining the value of Angle A include the solids concentration of the slurry, the percentage of hydrophobic particles in the solids contained in the slurry, the air flow rate to be used, and other considerations which will be discussed in connection with later described embodiments.

Inclusion of a conical, or generally conical, pedestal provides improved performance for the embodiments of the present invention in many applications for the reasons explained below.

First, investigation has revealed an off axis rotation of the center of the froth column produced in the embodiments illustrated in FIGS. 1–3 which incorporate the cylindrical froth pedestal. The off-axis rotation of the froth column can undesirably decrease the efficiency of the embodiment. By including a generally conical pedestal extending upwardly into the vessel, the froth column is stabilized.

Second, inclusion of a conical or generally conical pedestal guarantees that the pressure difference which is required to transport froth from the bottom of the vessel to the vortex finder will be created. Thus, with all other design and operational parameters remaining the same, the inclusion of a conical pedestal improves the transport of hydrophobic particles to the froth.

Third, the high air flow rates necessary to stabilize the froth column when using the cylindrical pedestal are not necessary when using the conical pedestal of the present invention. Thus, since it is not necessary to utilize the additional machinery necessary to provide a high air flow rate, the capital costs, as well as the size of the equipment and the costs of operation of the embodiment, are reduced. In view of the high cost of the equipment required to provide a high air flow rate in a commercial embodiment, the advantage of requiring a lower air flow rate for the same performance can be expected to provide substantial savings and thus increased profits.

Fourth, utilizing a conical pedestal, within the scope of the present invention, allows the size of the annular outlet 40 (FIG. 5) to be readily varied by withdrawing the pedestal from, or inserting the pedestal farther into, the vessel. Since means may be readily provided to vary the height of the pedestal within the vessel, altering the size of the annular opening may be routinely accomplished during operation of the embodiment. This feature allows the performance of the embodiment to be optimized in view of changing operating parameters or to flush blockages from the annular opening.

EXAMPLE 2

Figure 6:
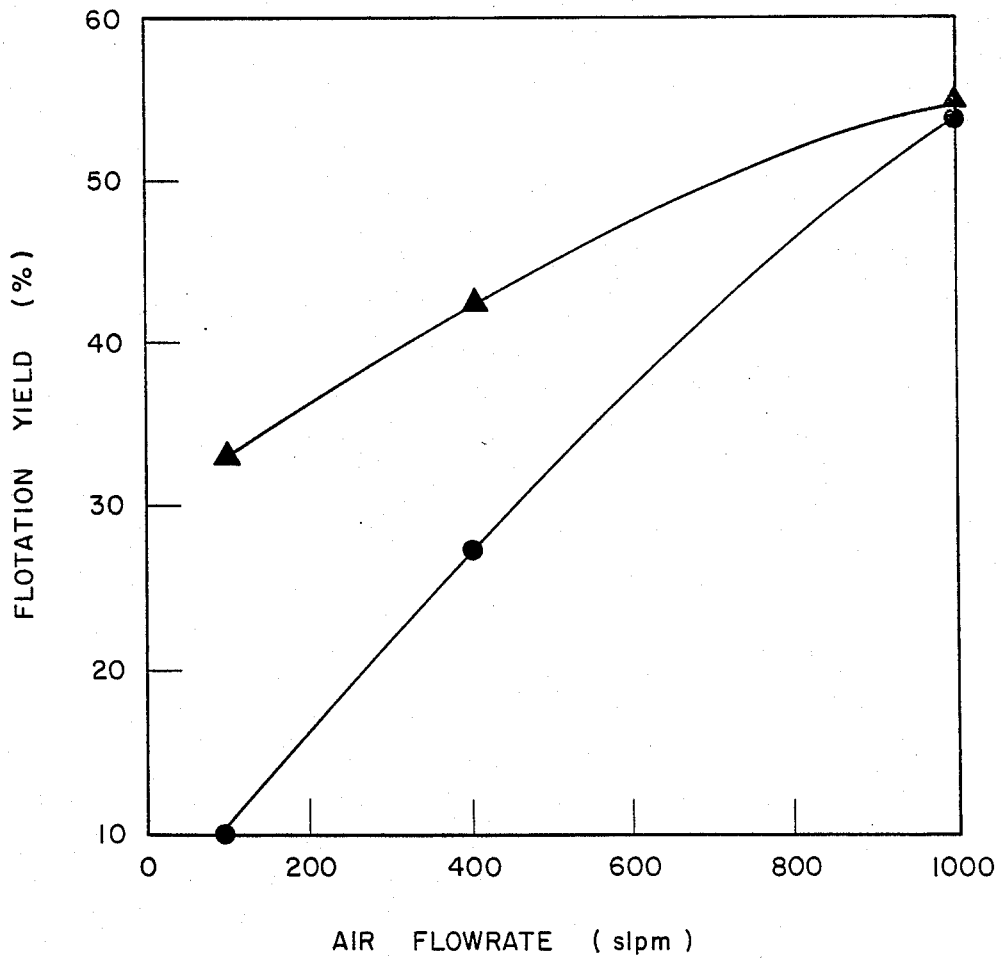
FIG. 6 is a graph comparing the experimental flotation rate and recovery using the apparatus and method of the third embodiment versus using the apparatus and method of the first embodiment.

The improved performance obtained by use of the conical pedestal in one particular application is set forth in the graph of FIG. 6. The comparative data graphed in FIG. 6 presents a comparison of the performance of an embodiment of the present invention having a structure generally similar to that shown in FIG. 5 against the performance of an embodiment of the present invention having a structure generally similar to that illustrated in FIG. 1.

The data contained in FIG. 6 was obtained by preparing a slurry containing a highly volatile Alabama bituminous coal sample. The solids concentration in the slurry was 5%. The particle size of the coal sample was 33.3% with 48 by 100 mesh, 25% with 100 by 200 mesh, and 41.7% with minus 200 mesh. The ash content of the coal sample was about 12.7%.

The slurry was conditioned in a sump for 10 minutes with the addition of 1 kg/ton of kerosene and 0.1 kg/ton MIBC. The dimensions of the experimental flotation vessel used were 5 cm by 35 cm (annular outlet to vortex finder). The slurry was fed into the flotation vessel at a pressure of 15 psig.

Two sets of tests were conducted. In the first set of tests a cylindrical pedestal was used with its diameter adjusted to 4.35 cm. The coal slurry was then tangentially introduced into the flotation vessel and the flotation yield was determined at each of three air flow rates.

The graph of FIG. 6 plots the flotation yields obtained using this cylindrical pedestal at the air flow rates of 1,000 slpm (standard liters per minute), 400 slpm, and 100 slpm, as represented at the circles on the graph, with the intermediate values being extrapolated by a connecting line. As can be seen in FIG. 6, the flotation yield decreased from greater than about 50% at 1,000 slpm air flow rate to only about 10% at 100 slpm.

In the second set of tests, a conically shaped pedestal was used; all other structures of the flotation vessel remained essentially the same as in the first set of tests. The dimensions of the vessel were, as before, 5 cm by 35 cm with the pedestal extending from the annular outlet to the vortex finder as shown in FIG. 5. However, the conical pedestal was provided with a cylindrical base having a diameter of 4.35 cm which provided an annular opening of the same size and shape as provided in the first set of tests. The conical pedestal was configured as a substantially true cone having an angle at its apex of about 7.0 degrees and which extend to the bottom of the vortex finder.

The coal slurry was introduced into this embodiment of the flotation vessel incorporating the conical pedestal and the flotation yield was also determined at each of three air flow rates. As in the first test, the flotation yields obtained using the conical pedestal are plotted on the graph of FIG. 6 at 1,000 slpm, 400 slpm, and 100 slpm (as represented by the triangles on the graph) with intermediate values being extrapolated by a connecting line.

As can be seen in FIG. 6, use of the conical pedestal resulted in only slightly better flotation yield at an air flow rate of 1,000 slpm. However, as air flow rates were reduced to 400 slpm and 100 slpm, flotation yields were dramatically improved by over 40% and 30%, respectively, compared to the flotation yields obtained with a cylindrical pedestal at the same air flow rates.

Thus, the results of this example set forth in FIG. 6 makes clear that in applications where a low air flow rate is desirable, or necessary due to cost limitations, the conical froth pedestal is preferred over the cylindrical froth pedestal. In particular, the conical froth pedestal performs unexpectedly well at low air flow rates. This is particularly notable in this example in view of the hydrophobic nature of the coal sample and the high slurry feed pressure used during the test.

EXAMPLE 3

Another example demonstrating the improved performance of the conical froth pedestal involved separating the constituents of a slurry of limestone and silica. The slurry used in this exmaple had a solids concentration of 14%. Chemical analysis showed that the feed solids contained 26.9% silica and 73.1% limestone.

The slurry was conditioned in a sump for 20 minutes with the addition of 0.8 kg/ton amine and 0.3 kg/ton MIBC prior to introduction into the apparatus. With such conditioning, the silica became hydrophobic so that the silica would be recovered as the overflow froth product and the limestone would be rejected as the underflow tailings product.

The vessel dimensions were 5.0 cm by 50.0 cm, and the slurry was introduced into the vessel at a feed rate of 50 liters per minute and an air flow rate of 1,500 slpm. Again, samples were processed using both a cylindrical froth pedestal, substantially the same as shown in FIG. 1, and a conically shaped froth pedestal, substantially the same as shown in FIG. 5 with the inclusion of a base as in Example 2.

The cylindrical pedestal was provided with a diameter of about 4.5 cm while the conical pedestal was provided with a base diameter of about 4.3 cm and an apex angle of about 8.0 degrees. The cylindrical pedestal extended above the annular outlet about 1 cm while the conical pedestal extended about two thirds (about 30 cm) of the height to the vortex finder.

Table 1, provided below, shows the results of this example and compares the results obtained using the conical pedestal and the cylindrical pedestal. As can be seen from the data contained in Table 1, the quality of the silica recovered improved substantially with the conical pedestal, while the percentage of silica recovered varied only slightly.

TABLE 1

| | Silica Recovered Through Froth Overflow | Grade of Silica In Froth Overflow |
|---|---|---|
| Cylindrical Pedestal | 70.9 | 48.7 |
| Conical Pedestal | 68.5 | 61.5 |

From the results described above in Examples 2 and 3, it will be appreciated that the conical pedestal improves the transport of hydrophobic particles into the froth column. Thus, with all other parameters being the same (e.g., the annular opening), use of the conical pedestal will significantly improve flotation recovery of hydrophobic particles, which is the case shown in Example 2. On the other hand, if the flotation recovery is desired to be maintained at the same level, the conical pedestal allows the use of a larger annular opening (smaller pedestal diameter) for more efficient rejection of hydrophilic particles thus improving the concentrate grade of hydrophobic particles in the froth overflow, which is the case shown in Example 3. In summary, one of the advantages of the conical pedestal is that it allows the percentage of desirable concentrate which is recovered to be increased or the grade (i.e., purity) of the concentrate to be improved while the percentage of concentrate recovered is maintained.

FIGS. 7–10 illustrate additional preferred embodiments of the present invention which include structures substantially the same as the previously described embodiments with the exception that each embodiment includes a slightly modified configuration of the conical pedestal.

Figure 7:
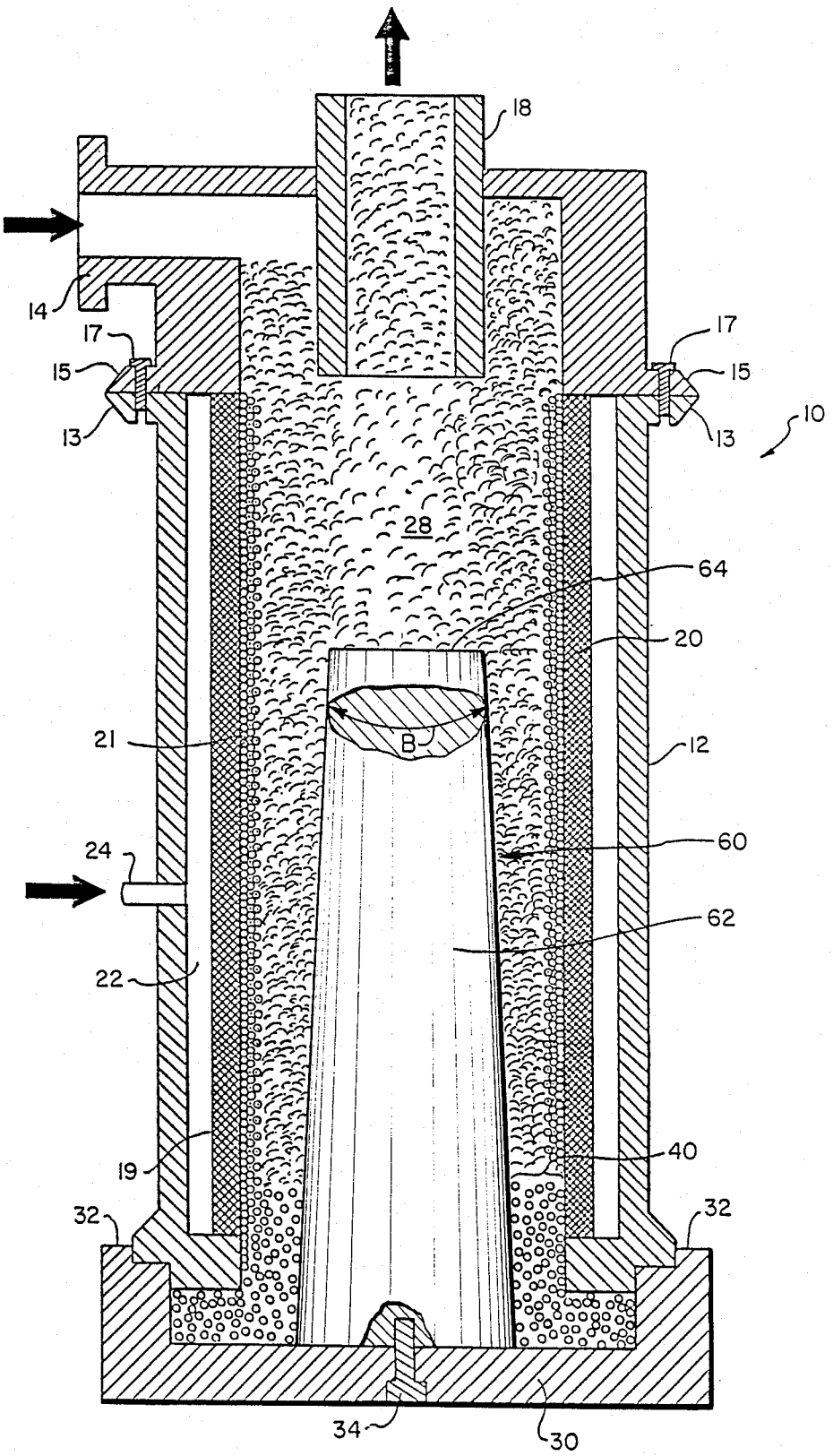
FIGS. 7, 8, 9, 10 and 11 are vertical, partially cross-sectional views of fourth, fifth, sixth, seventh, and eighth, respectively, presently preferred embodiments of the present invention, each embodiment incorporating a differently configured generally conical pedestal.

FIG. 7 illustrates a fourth preferred embodiment of the present invention incorporating another generally conical pedestal. The fourth embodiment includes lower portion 62 of pedestal (generally designated 60) which is configured at a first angle, Angle B in FIG. 7, while the upper portion of the pedestal is provided with a truncated top 64.

In conncention with the fourth embodiment, it should be appreciated that if the conical pedestal is provided with larger diameters (i.e., a steeper apex angle) an increased pressure gradient will be formed to "push" the froth product up to the vortex finder. By promoting transport of hydrophobic particles flow stabilization is increased.

Conversely, there is a tendency that as flow stability (e.g., the uptake of hydrophobic particles into the froth and out the vortex finder) is increased, the structural stability of the froth column decreases (e.g., the center of the froth column moves). In order to achieve the best balance between flow stability and structural stability of the froth column the conical pedestal may be truncated as shown in FIG. 7.

Figure 8:
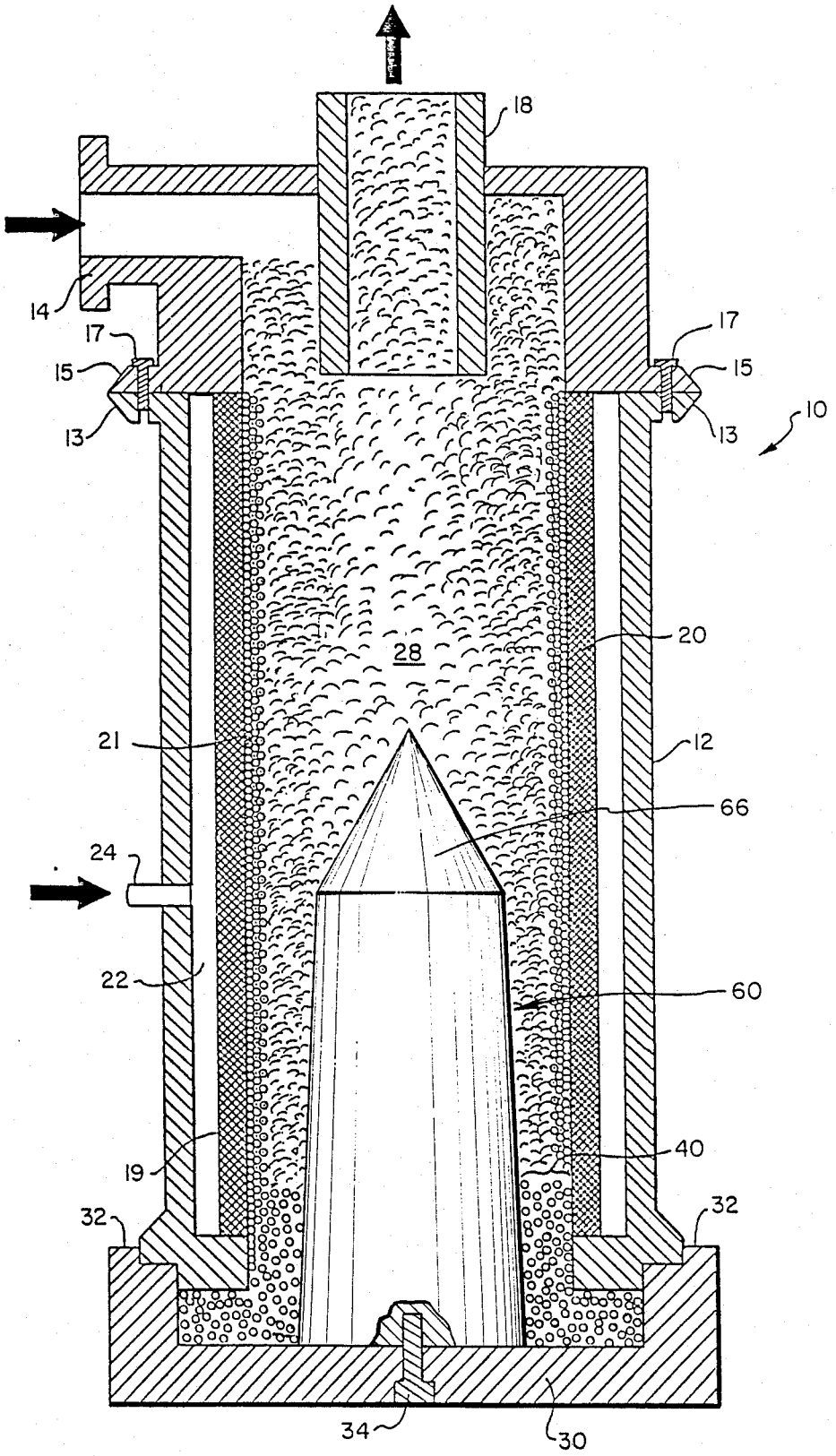
Figure 8A:
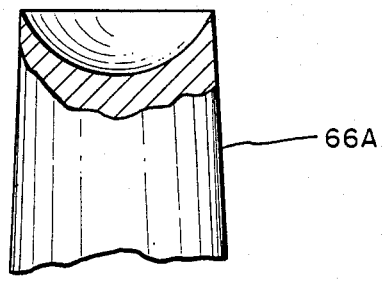
FIGS. 8A–8D are cross-sectional views of alternative structures which may be incorporated into the conical pedestal of the present invention.
Figure 8B:
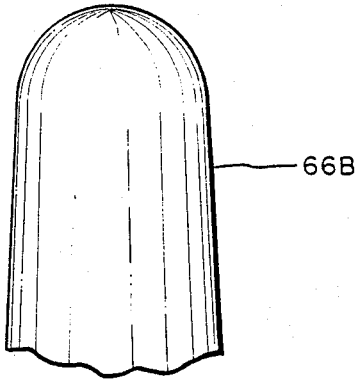
Figure 8C:
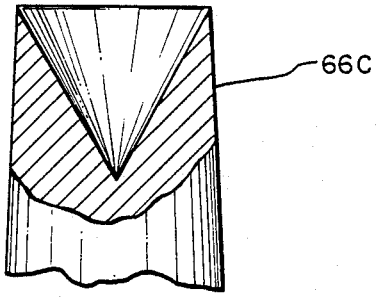
Figure 8D:
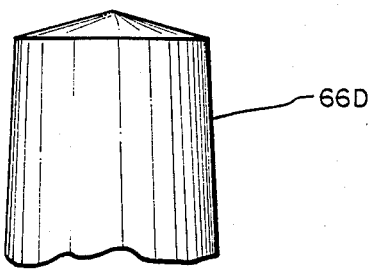

FIG. 8 illustrates a fifth preferred embodiment of the invention wherein the truncated pedestal is provided with cap 66 whose apex is provided with a different angle than that generally exhibited by pedestal 60. Furthermore, in order to finely adjust the desired balance between flow stability and structural stability, the conical pedestal may be truncated in any of caps 66A–66D shown in FIGS. 8A–8D. Importantly, concave caps (such as those illustrated in FIGS. 8A and 8D) will provide more focusing of the froth column and thus increase structural stability. Conversely, convex shapes (such as those illustrated in FIGS. 8B and 8D) provide less focusing of the froth column and improved flow stability.

Figure 9:
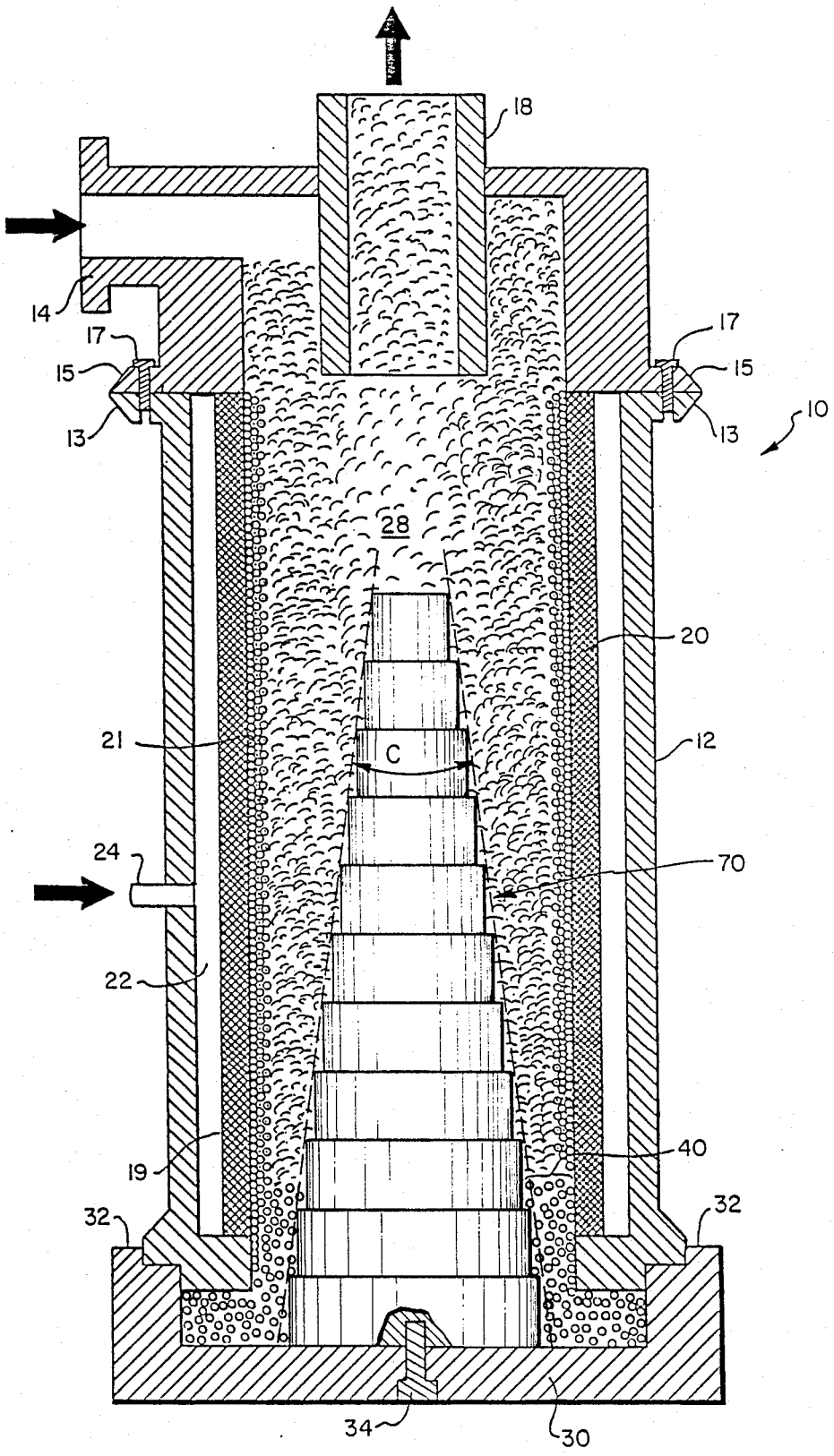

FIG. 9 shows a sixth preferred embodiment wherein the generally conical pedestal (generally indicated at 70) incorporates a "terraced" surface and a truncated top surface. The use of the embodiment shown in FIG. 9 is dictated by many of the same considerations raised in connection with the earlier described embodiments, such as achieving the desired flow stability and froth column structural stability. The dashed lines provided in FIG. 9 generally indicated the apex angle of the pedestal, the apex angle being generally designated at Angle C.

Moreover, it should be appreciated that if the feed material contains a high percentage of product which is to be recovered (e.g., 80%–95% of the feed material is hydrophobic and to be recovered in the froth) or if the product to be recovered has low floatability, the conical pedestal should be configured to provide the upward pressure gradient necessary to transport the hydrophobic particles through the vortex finder with the froth. The pedestal shown in FIG. 9 provides such an upward pressure gradient.

Figure 10:
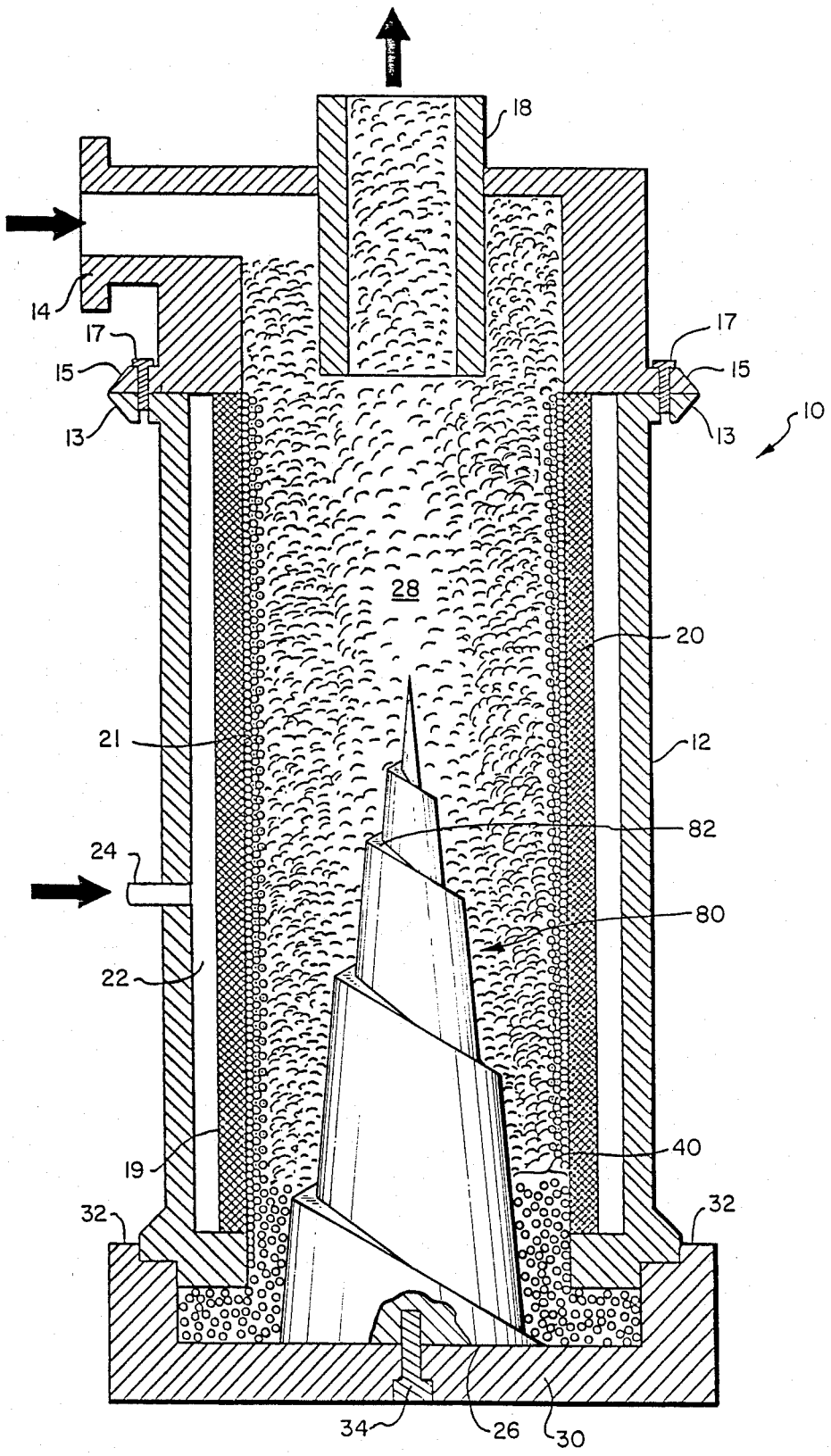

FIG. 10 illustrates a seventh embodiment utilizing a conically shaped pedestal 80 which is provided with a spiral ledge 82. Importantly, the spiral ledge may be configured to oppose the direction of the feed or to correspond the direction of the feed in accordance with whether there is a need to retard transport of particles to the froth column and vortex finder (such as when a very concentrated overflow product is desired) or to assist the transport of particles (such as may be necessary when a high percentage of the feed material is to be recovered).

Moreover, a driving means (not shown) may be provided for rotating all of the potential herein described, including the pedestal of FIG. 10, in accordance with the just described considerations.

Figure 11:
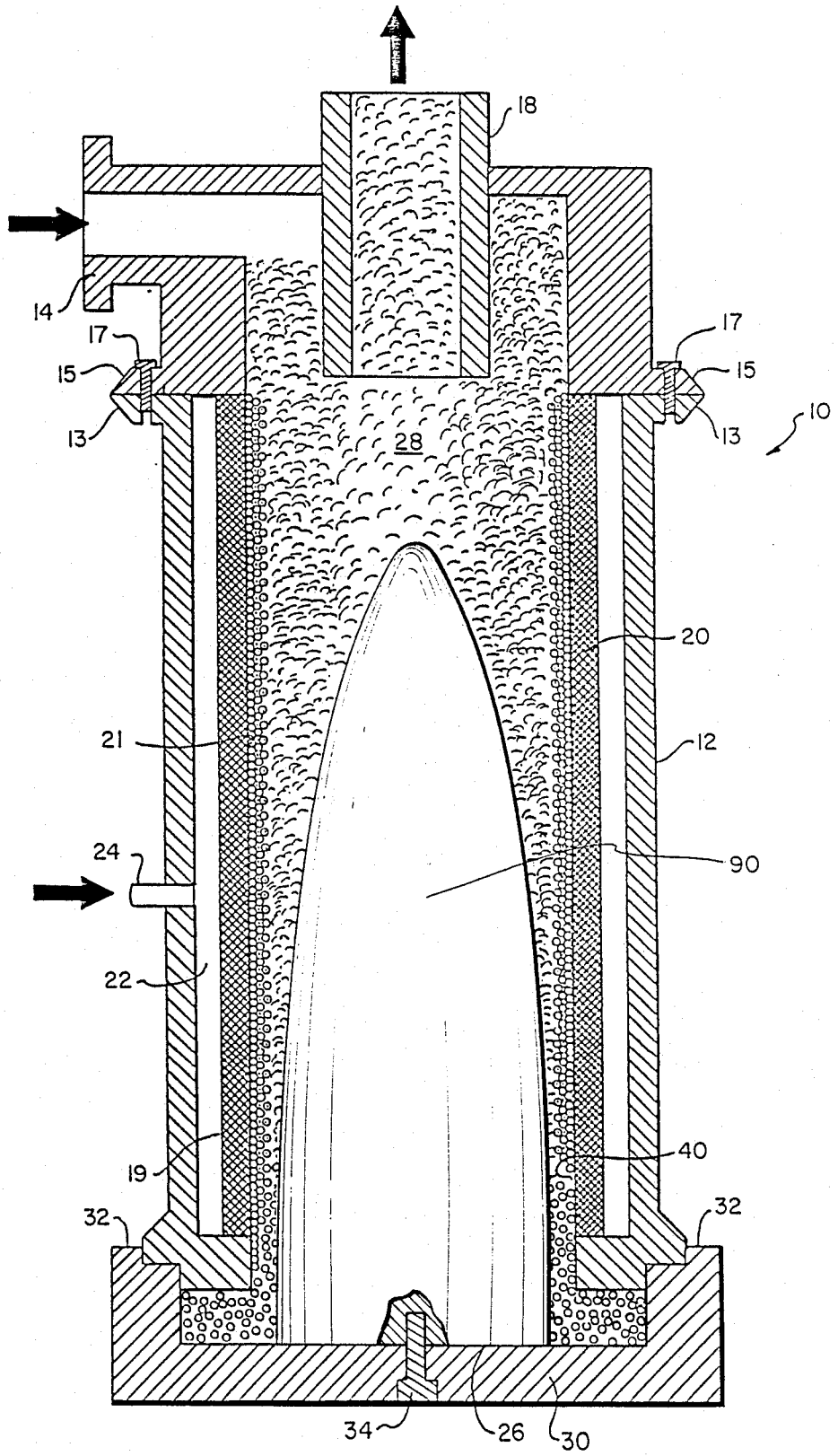

FIG. 11 sets forth an eighth embodiment incorporating a generally conical pedestal 90 with a nonlinearly sloping side and a smooth and rounded apex. With an understanding of the principles hereinabove described, those skilled in the art will be able to determine when it may be advantageous to use a conical pedestal such as shown in FIG. 11.

It will be appreciated from the previous discussion that any one of the embodiments just described may provide better performance in any one particular application than the other embodiments. For example, considerations of structural froth column stability and flow stability within the vessel may cause one embodiment to be preferred over the others. Significantly, all of the embodiments provide improved performance over prior art systems and methods. Additionally, embodiments of the present invention using the principles herein described may be adapted for optimum performance over a widely vary in range of feed material conditions.

EXAMPLE 4

In this example, a device substantially the same as that shown in FIG. 5 and incorporating a generally conical pedestal having an apex angle of 4° is used to separate a slurry containing silica and limestone, and using amine as a collector, by subjecting the slurry to the process of the invention. Such a device may have vessel dimensions of about 15 cm by about 210 cm and be used in commercial applications. The base of the conical pedestal may be provided with a diameter of about 14.5 cm and the pedestal extending substantially the entire 210 cm length of the vessel.

It is expected that due to relatively poor froth stability of silica with amine as the collector, that the froth core cannot sustain its own weight (a cylindrical volume of about 16,500 cc with the cylindrical froth pedestal shown in FIG. 1, causing poor flotation separation. On the other hand, very good separation should be possible using the conical pedestal which provides better froth stability.

EXMAPLE 5

In this example, a device substantially the same as that shown in FIG. 8 and incorporating a generally conical pedestal having an apex angle of 30° is used to float baseped elemental sulfur from gangue. The vessel dimensions are about 16.5 cm × 120 cm. The base diameter of the conical pedestal is about 15 cm. The slurry containing the materials is subjected to the process of the present invention.

Good separation is expected in this example. It should be noted that the conical pedestal shown in FIG. 8 is expected to aid the flotation of baseped elemental sulfur. Baseped elemental sulfur is extremely hydrophobic and the sulfur particles tend to flocculate together. The resulting flocs behave as large particles which are difficult to float. The conical pedestal used in this example overcomes this difficulty by providing better transport of hydrophobic particles to the overflow froth.

In view of the foregoing, it will be appreciated that the present invention provides numerous advantages over those apparatus and methods available in the prior art. The present flotation apparatus may be adapted for use with varying operational parameters and with different material conditions while resulting in performance that is much better than that experienced using any device found in the prior art.

Moreover, a variety of froth conditions may be supported and accommodated using the present invention. Use of the present invention also minimizes mixing between the froth and the fluid flow as well as minimizing destruction of the froth during operation. Also, embodiments of the present invention allow the water split to be controlled while increasing the overall efficiency of the flotation process to a degree not otherwise available in the art.

The present invention also provides for flotation of fine particles which heretofore were not recoverable with conventional flotation apparatus and methods. Moreover, the present invention allows consideration of both the flow stability and the structural stability of the froth column within to vessel when devising an embodiment. Still further, the present invention allows embodiments to be configured which will provide optimum performance for each slurry to be subjected to the process of the present invention.

It will be understood that the present invention may be embodied in other specific forms within departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An air sparged hydrocyclone flotation apparatus for separating particles from a particulate suspension, comprising:

an upright generally cylindrical vessel having a generally circular cross-section and further having an upper portion terminating in an upper end and a lower portion terminating in a lower end;

a tangential inlet in the upper portion of the vessel for introducing the particulate suspension into the vessel in a generally tangential fashion;

means for introducing gas into the vessel to contact the particulate suspension, the gas forming small bubles which combine with particles in the particulate suspension to form flotation, the bubble/particle aggregates forming a froth within the vessel thereby leaving a fluid discharge;

a froth outlet means extending coaxially with the vessel from said froth outlet means lowest point located in the upper portion of the vessel to the exterior of the upper end of the vessel;

a pedestal positioned within the vessel, the base of the pedestal extending from the lower end of the vessel upwardly to at least one-half the distence from the lower end of the vessel to the lowest point of the froth outlet means, the cross-sectional area of the pedestal linearly or non-linearly decreasing upwardly from a maximum at its base to a minimum at its uppermost end and the cross-sectional area being substantially circular at any plane taken perpendicular to the vertical axis of the pedestal along the pedestal, the pedestal base having a diameter at least half the diameter of the vessel; and an outlet formed in the lower portion of the vessel such that the outlet has a generally annular configuration and is defined by a space between the pedestal and the inner wall of the lower portion of the vessel, said annular outlet directing the fluid discharge from the particulate suspension out of the vessel without substantial disturbance of the fluid flow within the vessel.

2. A flotation apparatus for separating particles from a particulate suspension as defined in claim 1 wherein the pedestal has a generally conical configuration.

3. A flotation apparatus for separating particles from a particulate suspension as defined in claim 1 wherein at least a portion of a wall of the vessel comprises a porous wall, and wherein the gas introducing means comprises a gas plenum surrounding the porous wall portion of the vessel, the porous wall providing for the passage of gas from the gas plenum into the particulate suspension within the vessel.

4. A flotation apparatus for separating particles from a particulate suspension as defined in claim 1 wherein said froth outlet means comprises a vortex finder.

5. A flotation apparatus for separating particles from a particulate suspension as defined in claim 1 wherein the pedestal extends into the vessel two-thirds the distance to the lowest point of the froth outlet means.

6. A flotation apparatus for separating particles from a particulate suspension as defined in claim 1 wherein the pedestal is a generally conical pedestal and includes a truncated upper portion.

7. A flotation apparatus for separating particles from a particulate suspension as defined in claim 1 wherein the pedestal includes curved sides forming a rounded apex.

8. A flotation apparatus for separating particles from a particulate suspension as defined in claim 1 wherein the pedestal side is provided with a plurality of steps.

9. A flotation apparatus for separating particles from a particulate suspension as defined in claim 1 wherein the pedestal side is provided with a spiral ledge.

10. A flotation apparatus for separating particles from a particulate suspension as defined in claim 1 wherein the pedestal is generally conical and is provided with an apex and means to adjust to the angle of the pedestal apex.

11. A flotation apparatus for separating particles from a particulate suspension as defined in claim 1 wherein the lower end of the vessel comprises a pedestal support mounted to the lower portion of the vessel such that a peripheral discharge is defined by a space between the lower portion of the vessel and the pedestal support, the pedestal being mounted to the pedestal support.

12. A flotation apparatus for separating particles from a particulate suspension as defined in claim 1 further comprising a tangential discharge in the lower portion of the vessel communicating with the annular outlet.

13. A flotation apparatus for separating particles from a particulate suspension as defined in claim 1 further comprising driving means for rotating the pedestal.

14. A flotation apparatus for separating particles from a particulate suspension as defined in claim 1 further comprising means for centering the pedestal within the vessel.

15. A flotation apparatus for separating particles from a particulate suspension as defined in claim 1 further comprising means for selectively displacing the pedestal in both upward and downward directions within the vessel.

16. A flotation apparatus for separating particles from a particulate suspension as defined in claim 1 wherein the pedestal is generally conical and includes an apex and wherein the apex forms an angle in the range from about 4 degrees to about 30 degrees.

17. A flotation apparatus for separating particles from a particulate suspension as defined in claim 16 wherein the apex forms an angle in the range from about 5 degrees to about 20 degrees.

18. An air sparged hydrocyclone flotation apparatus for separating particles from a particulate suspension, comprising:

a generally vertically oriented vessel having a generally cylindrical configuration and having an upper portion terminating in an upper end and a lower portion terminating in a lower end, at least a portion of a wall of the vessel comprising a porous wall;

a tangential inlet in the upper portion of the vessel for introducing a particulate suspension into the vessel in a generally tangential fashion;

an outlet in the lower portion of the vessel, the outlet having a generally annular configuration such that the outlet directs fluid discharge from the particulate suspension out of the vessel without substantial disturbance of the fluid flow within the vessel;

a gas plenum surrounding the porous wall portion of the vessel, the porous wall providing for the passage of gas from the gas plenum into the particulate suspension within the vessel, the gas forming small bubbles which separate particles from the particulate suspension by flotation, the gas bubbles and separated particles congregating within the vessel to form a froth;

inlet means in the vessel for supplying gas to said gas plenum;

froth outlet means extending coaxially with the vessel from said froth outlet means lowest point located in the upper portion of the vessel to the exterior of the upper end of the vessel; and a generally conical pedestal extending from its base at the lower end of the vessel upwardly to at least one-half the distence from the lower end of the vessel to the lowest point of the froth outlet means, the annular outlet being defined by a space between the base of the pedestal and the inner wall of the lower portion of the vessel, the diameter of the base of the pedestal being at least half the diameter of the vessel.

19. A flotation apparatus for separating particles from a particulate suspension as defined in claim 18 further comprising means for altering the height into which the pedestal extends into the vessel and for altering the angle formed by the apex of the conical pedestal.

20. A flotation apparatus for separating particles from a particulate suspension as defined in claim 19 wherein the apex forms an angle in the range from about 5 degrees to about 20 degrees.

21. A flotation apparatus for separating particles from a particulate suspension as defined in claim 18 wherein said froth outlet means further comprises a tubular vortex finder wherein the pedestal extends at least one-half the distance to the lowest point of the vortex finder.

22. A flotation apparatus for separating particles from a particulate suspension as defined in claim 21 wherein the pedestal extends into the vortex finder.

23. A flotation apparatus for separating particles from a particulate suspension as defined in claim 18 wherein the pedestal is symmetrical about its vertical axis and its diameter decreases nonlinearly.

24. A flotation apparatus for separating particles from a particulate suspension comprising:

a generally vertically oriented cylindrical vessel having a substantially circular cross-section; and having an upper portion terminating in an upper end and a lower portion terminating in a lower end;

a tangential inlet in the upper portion of the vessel for introducing a particulate suspension into the vessel in a generally tangential fashion;

means for introducing a gas into the vessel to contact the particulate suspension adjacent the wall of the vessel, the gas forming small bubbles which separate particles from the particulate suspension by flotation, the separated particles and bubbles forming a froth within the vessel thereby leaving a fluid discharge; froth outlet means extending coaxially with the vessel from the front froth outlet means lowest point located in the upper portion of the vessel to the exterior of the upper end of the vessel a pedestal positioned within the vessel, said pedestal being configured to be generally symmetrical about its vertical axis and generally conical in shape, the pedestal extending upwardly fron the lower end of the vessel to at least one half the distance from the lower end to the inlet, means to adjust the height of the pedestal so as to allow the operation of the apparatus to be controlled, the pedestal also having a base with a diameter of at least half of the diameter of the vessel; and an outlet formed in the lower portion of the vessel such that the outlet has a generally annular configuration and is defined by a space between the pedstal and the inner wall of the lower portion of the vessel, said outlet directing the fluid discharge from the particulate suspension out of the vessel without substantial disturbance of the fluid flow within the vessel.

25. A flotation method for separating particles from a particulate suspension, comprising the steps of:

obtaining a generally cylindrical vessel having a generally circular cross-section and a generally vertical orientation said vessel having an upper portion terminating in an upper end and a lower portion terminating in a lower end, the vessel further having a pedistal extending upwardly from the base of of the pedistal located at the lower end of the vessel to at least one-half of the length of the vessel, the pedistal having a linearly or non-linearly decreasing diameter going from a maximum diameter at its base to a minimum diameter at its uppermost end and the cross-sectional area of the pedistal being substantially circular at any transverse plane along the pedistal and the diameter of the base of the pedistal being at least half of the diameter of the vessel;

introducing a particulate suspension into the upper portion of the vessel in a generally tangential fashion;

introducing gas into the particulate suspension adjacent a wall of the vessel, the gas forming small bubbles which separate particles from the particulate suspension by flotation, thereby leaving a fluid discharge, the separated particles and bubbles forming a froth within the vessel; and removing the froth from the vessel.

26. A flotation method for separating particles from a particulate suspension as defined in claim 25 wherein at least a portion of a wall of the vessel is a porous wall, and wherein the gas introducing step comprises sparging gas through the porous wall and into the particulate suspension within the vessel, the gas forming small bubbles within the particulate suspension.

27. A flotation method for separating particles from a particulate suspension as defined in claim 25 further comprising step of removing the froth from an outlet formed coaxial with the vessel in the upper end of the vessel.

28. A flotation method for separation particles from a particulate suspension as defined in claim 25 further comprising the step of controlling the amount of material leaving the vessel in the froth and the amount of material leaving the vessel in the fluid discharge by adjusting the height of the pedestal.

29. A flotation method for separating particles from a particulate suspension as defined in claim 25 further comprising the step adjusting the angle of the apex of the pedestal.

30. A flotation method for separating particles from a particulate suspension as defined in claim 25 further comprising the step of rotating the pedestal.

31. A flotation method for separating hydrophobic particles from a particulate suspension comprising the steps of:

obtaining a generally cylindrical vessel having a generally vertical orientation, at least a portion of wall of the vessel comprising a porous wall, the vessel having an upper portion terminating in an upper end and a lower portion terminating in a lower end, said vessel further having a generally conical pedistal within the vessel, said pedistal extending upwardly from the base of the pedistal located at the lower end of the vessel to at least one-half the length of the vessel, the pedistal servind to direct the froth upwardly through the vessel and to guide the fluid discharge out of the lower portin of the vessel in an annular fashion, the base of the pedistal having a diameter of at least one-half the diameter of the vessel;

introducing a particulate suspension into the upper portion of the vessel in a generally tangential fashion;

sparging air through the porous wall and into the particulate suspension within the vessel, the air forming small bubbles which form bubble/particle aggregates with hydrophobic particles in the particulate suspension thereby leaving a fluid discharge;

collecting the bubble/particle aggregate to form a froth;

directing the fluid discharge out of a lower end of the vessel in a generally annular fashion such that the fluid discharge does not substantially disturb the fluid flow within the vessel; and removing the froth from an outlet coaxial with cylinder formed in the upper end of the vessel.

* * * * *

UNITED STATES PATENT AND TRADEMARK OFFICE

CERTIFICATE OF CORRECTION

PATENT NO. : 4,838,434

DATED : June 13, 1989

INVENTOR(S) : Jan D. Miller et al.

It is certified that error appears in the above-identified patent and that said Letters Patent is hereby corrected as shown below:

Column 3, line 28, "to recovery" should be --to recover--
Column 6, line 6, "maintian" should be --maintain--
Column 7, line 58, "a" should be --A--
Column 13, line 27, "will met" should be --will meet--
Column 13, line 51, "does to not disturb" should be --does not disturb--
Column 13, line 62, "slighly" should be --slightly--
Column 15, line 23, "correspondence" should be --corresponds--
Column 15, line 52, "heigth" should be --height--
Column 22, line 3, "bubles" should be --bubbles--
Column 23, line 66, "distence" should be --distance--
Column 24, line 42, delete "front"
Column 24, line 44, "vessel" should be --vessel;--
Column 24, line 48, "fron the" should be --from the--
Column 24, line 67, "orientation" should be --orientation,--
Column 25, line 2, "pedistal" should be --pedestal--
Column 25, line 3, "pedistal" should be --pedestal--
Column 25, line 10, "pedistal" should be --pedestal--
Column 25, line 32, "comprising step" should be --comprising the step--
Column 26, line 1, "the step adjusting" should be --the step of adjusting--

UNITED STATES PATENT AND TRADEMARK OFFICE

CERTIFICATE OF CORRECTION

PATENT NO. : 4,838,434

DATED : June 13, 1989

INVENTOR(S) : Jan D. Miller et al.

It is certified that error appears in the above-identified patent and that said Letters Patent is hereby corrected as shown below:

Column 25, lines 5, 8 and 11, "pedistal" should be --pedestal--;

Column 26, lines 15, 16, 18 and 21, "pedistal" should be --pedestal--.

Signed and Sealed this

Fourteenth Day of May, 1991

*Attest:*

HARRY F. MANBECK, JR.

*Attesting Officer*

*Commissioner of Patents and Trademarks*